US005439123A

United States Patent [19]

Nook

[11] Patent Number: 5,439,123

[45] Date of Patent: Aug. 8, 1995

[54] DISPLAY SYSTEM

[75] Inventor: Thomas J. Nook, Grand Haven, Mich.

[73] Assignee: Harbor Industries, Inc., Grand Haven, Mich.

[21] Appl. No.: 186,903

[22] Filed: Jan. 25, 1994

Related U.S. Application Data

[63] Continuation-in-part of Ser. No. 101,578, Aug. 3, 1993.

[51] Int. Cl.[6] ..... A47F 5/00

[52] U.S. Cl. ..... 211/187; 211/184

[58] Field of Search ..... 211/187, 184, 189; 108/144, 111, 60, 61; 160/135

[56] References Cited

U.S. PATENT DOCUMENTS

| | | | |
|---|---|---|---|
| 299,602 | 6/1884 | Ward . | |
| 1,747,496 | 2/1930 | Vanderveld . | |
| 1,760,456 | 5/1930 | Von Palmenberg . | |
| 1,770,942 | 7/1930 | Morris . | |
| 1,937,935 | 12/1933 | Zimmerman . | |
| 2,102,657 | 12/1937 | Von Palmenberg . | |
| 2,605,525 | 8/1952 | Thomas . | |
| 3,067,882 | 12/1962 | Ribbens et al. . | |
| 3,186,363 | 6/1965 | Moore . | |
| 3,216,377 | 11/1965 | Gunn . | |
| 3,244,127 | 4/1966 | Evans . | |
| 3,247,809 | 4/1966 | Thomson . | |
| 3,489,290 | 1/1970 | Larson . | |
| 3,497,081 | 2/1970 | Field . | |
| 3,517,623 | 6/1970 | Goldstein et al. . | |
| 3,534,863 | 10/1970 | Howard . | |
| 3,640,389 | 2/1972 | Snyder . | |
| 3,677,202 | 7/1972 | Young . | |
| 3,687,091 | 8/1972 | Boylan . | |
| 3,834,092 | 9/1974 | Whisson . | |
| 3,868,021 | 2/1975 | Heinrich . | |
| 4,018,019 | 4/1977 | Raith et al. . | |
| 4,164,287 | 8/1979 | Muller et al. . | |
| 4,171,052 | 10/1979 | Winn . | |
| 4,183,438 | 1/1980 | Huczek . | |
| 4,186,666 | 2/1980 | Honickman . | |
| 4,274,687 | 6/1981 | Bayles et al. . | |
| 4,320,935 | 3/1982 | Nagelkirk . | |
| 4,329,003 | 5/1982 | Manchester . | |
| 4,349,113 | 9/1982 | Schreiner . | |
| 4,382,640 | 5/1983 | Kashden . | |
| 4,433,880 | 2/1984 | Maravelas, Jr. et al. . | |
| 4,508,300 | 4/1985 | Minick . | |
| 4,528,914 | 7/1985 | Montet . | |
| 4,540,222 | 9/1985 | Burrell . | |
| 4,561,550 | 12/1985 | Franklin . | |
| 4,650,261 | 3/1987 | Winter et al. . | |
| 4,684,094 | 8/1987 | Everett . | |
| 4,744,612 | 5/1988 | Winter et al. . | |
| 4,765,492 | 8/1988 | Howard et al. | 211/184 X |
| 4,887,783 | 12/1989 | Franklin . | |
| 4,928,833 | 5/1990 | Huizenga . | |
| 4,936,641 | 6/1990 | Bussan et al. . | |
| 4,949,853 | 8/1990 | Klein et al. | 211/184 X |
| 5,002,248 | 3/1991 | Knape et al. . | |
| 5,004,202 | 4/1991 | Stumpf et al. . | |
| 5,127,340 | 7/1992 | Mars et al. | 211/187 X |
| 5,135,194 | 8/1992 | Langhon et al. . | |
| 5,140,915 | 8/1992 | Knape . | |
| 5,201,191 | 4/1993 | Bastos | 211/187 X |

FOREIGN PATENT DOCUMENTS

| | | |
|---|---|---|
| 36899 | 5/1967 | Finland . |
| 1519227 | 2/1968 | France . |
| 3007952 | 10/1981 | Germany . |
| 184778 | 8/1963 | Sweden . |
| 1261512 | 1/1972 | United Kingdom . |

*Primary Examiner*—Ramon O. Ramirez

*Assistant Examiner*—Sarah L. Purol

*Attorney, Agent, or Firm*—Price, Heneveld, Cooper, DeWitt & Litton

[57] ABSTRACT

A display system includes a plurality of upright dividers with shelf supporting fasteners located therein, and further includes shelves that engage the protruding ends of the fasteners to form a rigid assembly. In one version aspect, the display system is freestanding, and includes a back panel and connectors for drawing the upright dividers against the back panel to form a freestanding, rigid arrangement. In those applications where a wood shelf or composite material shelf is desirable, a reinforcement bracket is provided for increased service life. In another aspect, headers are provided for supporting a graphic insert. In yet another aspect, a work surface is mounted between dividers, and shelves are used to stabilize the pair of dividers that support the work surface. Also, a modular display system is disclosed including modules positionable between dividers, the modules including notched sides configured to engage fastener ends protruding from the sides of the dividers.

18 Claims, 15 Drawing Sheets

DISPLAY SYSTEM

REFERENCE TO EARLIER FILED APPLICATION

This is a continuation in part of application Ser. No. 08/101578, filed Aug. 3, 1993, entitled "DISPLAY SYSTEM", the entire disclosure of which is incorporated herein by reference.

BACKGROUND OF THE INVENTION

The present invention relates to a display system, and more particularly concerns a display system that can be readily assembled to conventional gondola shelving, to a conventional building wall or as a freestanding unit by unskilled labor in different arrangements without the use of sophisticated tools, but which is structurally rigid and aesthetically pleasing.

Modern merchandizing requires that a display system be visually attractive to consumers, and also structurally sound so that a large number and variety of goods can be safely supported on the display system. Many display systems have been designed for this purpose, however known systems are often expensive to purchase and install since they include many specialized parts and require at least some semi-skilled labor for installation. Further, most of these systems cannot be easily assembled into different arrangements, cannot be easily disassembled and rearranged, and do not permit quick assembly and installation with unskilled labor. More specifically, the known display systems are not as flexible as desired.

Thus, a display system solving the aforementioned problems is needed.

SUMMARY OF THE INVENTION

The present invention includes a freestanding display system including a plurality of elongated upright dividers having a back edge; and sides, the dividers including first apertures located in the sides and further including second apertures located in the back edge. A plurality of shelf supporting members are shaped to be selectively located in the first apertures of the upright dividers, each of the shelf supporting members including at least one end protruding from one of the divider sides. A plurality of shelves are releasably frictionally engageable with the protruding ends. A back panel is provided including third apertures alignable with the second apertures. Connectors are extended through the third apertures into the second apertures, and retainers are located in the second apertures for engaging the connectors and for securing the dividers to the back panels. In a preferred form, the retainers engage the connectors in a manner that draws the upright dividers against the back panel to increase the rigidity of the display system.

The preferred embodiments of the present invention include several advantages over known systems. The display systems can be readily assembled by unskilled labor without the use of sophisticated tools onto conventional gondola shelving, building walls or as a fleestanding unit. Yet, the display system has a modern appearance with clean lines, and can be assembled in a variety of different functional arrangements. Still further, the assembled display system is structurally sound, yet permits quick rearrangement as desired. Notably, the display system can be assembled and/or rearranged relatively quickly and without sophisticated tools.

These and other features, advantages and objects of the present invention will be further understood and appreciated by those skilled in the art by reference to the following specification, claims and appended drawings.

BRIEF DESCRIPTION OF THE DRAWINGS

FIG. 11 is a side view of the shelf shown in FIG. 10 including an extruded label retainer;

FIG. 24 a perspective view of another modified display system embodying the present invention, the display system being shown as installed on a conventional building wall including 2×4 wooden studs;

FIG. 25 is an exploded fragmentary perspective view of the display system illustrated in FIG. 24;

FIG. 26 is a fragmentary side view of the display system illustrated in FIG. 24;

FIG. 27 is a fragmentary exploded perspective modified display system embodying the present invention, the display system including a vacuum formed shelf;

FIG. 28 is a perspective view of the vacuum formed shelf illustrated in FIG. 27;

DETAILED DESCRIPTION OF THE PREFERRED EMBODIMENT

Figure 1:
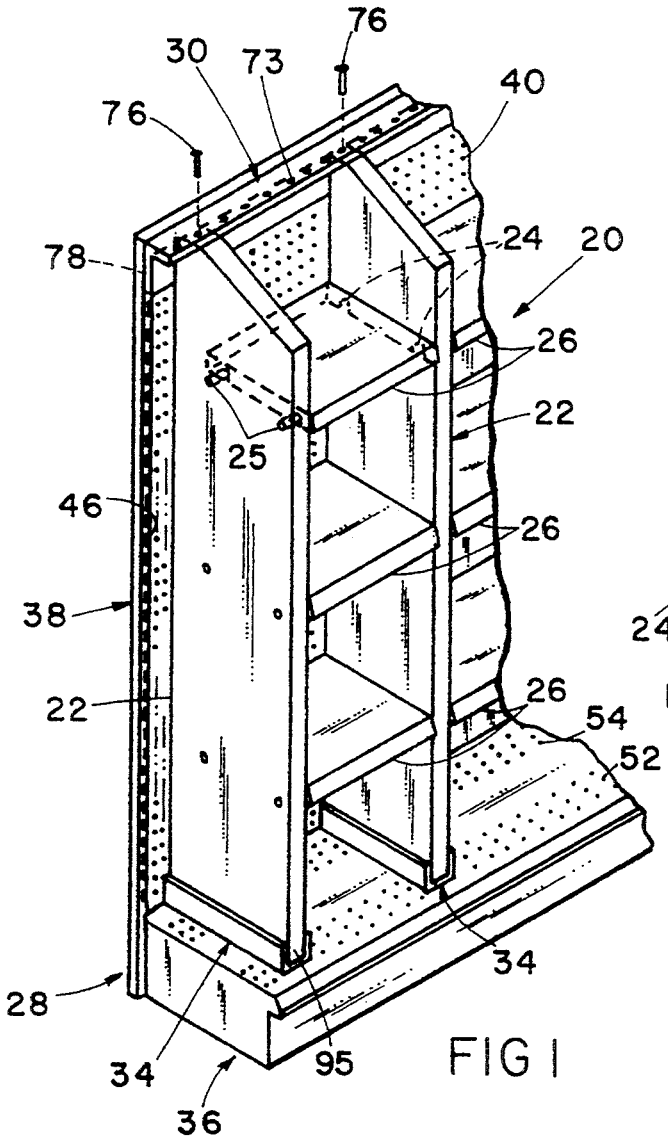
FIG. 1 a fragmentary top front perspective view of a display system embodying the present invention, the display system being shown as installed on conventional gondola shelving.

A display system 20 (FIGS. 1 and 2) embodying the present invention includes a plurality of panel-shaped upright dividers 22 with shelf supporting pins or fasteners 24 and 25 positioned therein, and further includes shelves 26 that engage shelf supporting pins 24 and 25 to form a rigid assembly. Display system 20 is adapted for installation on conventional gondola shelving 28, which shelving 28 includes a base 36 and an upright back 38 attached to base 36. Specifically, upright dividers 22 are secured in an upright and structurally square position on conventional gondola shelving 28 by top bracket 30, top bracket 30 being secured to the top rear corners of the upright dividers 22 and being releasably engaged to back 38 of the conventional gondola shelving 28. Locators 34 engage the bottom of upright dividers 22 to insure that the position of the upright dividers 22 do not become skewed, locators 34 engaging base 36 of the conventional gondola shelving 28 so that locators 34 properly locate the divider bottoms.

Back 38 of conventional gondola shelving 28 (FIG. 2) includes a plurality of peg boards 40 (only one of which is shown) connected by vertically oriented tubular supports or anchor rails 42 located at four foot centers. The tubular support 42 includes a flat front surface 44 with vertically oriented slots 46 therein. Base 36 (FIG. 1) of conventional gondola shelving 28 supports back 38 and extends forward of back 38, base 36 being adapted to support display system 20 and merchandizing items placed thereon in a raised position in front of back 38 above a store floor. Base 36 includes an upper surface 50 that has a series of front and rear holes 52 and 54, respectively.

Figure 4:
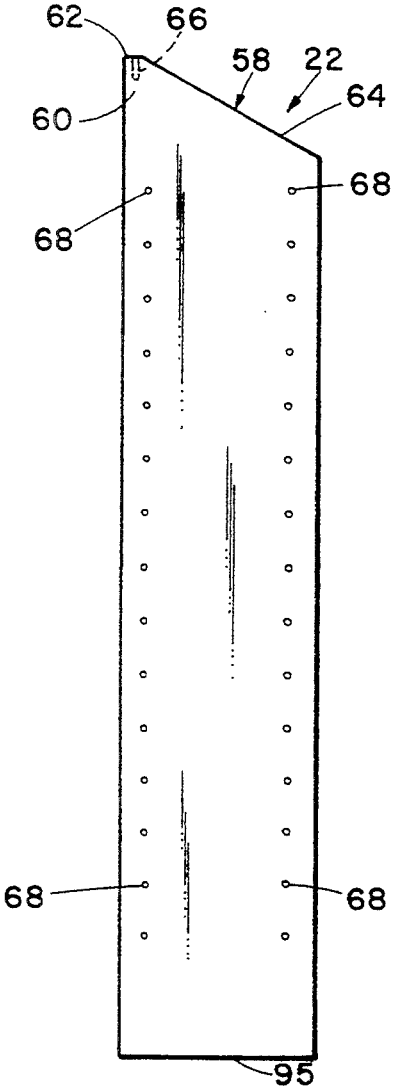
FIG. 4 is a side view of the upright divider shown in FIG. 1.

Upright dividers 22 (FIG. 4) are planar elongated structural members. The top of the upright dividers 22 can be a number of different shapes, but as illustrated top 58 of dividers 22 includes an upper rear corner 60 that forms a horizontal surface 62, and a forwardly extending portion 64 that is angled for aesthetics. A hole 66 extends vertically into the top of divider 22 through horizontal surface 62 of upper rear corner 60. Additional pin receiving shelf locating holes or apertures 68 extend through upright divider 22 from side to side, with pairs of holes 68 being located horizontally with respect to each other.

Figure 7:
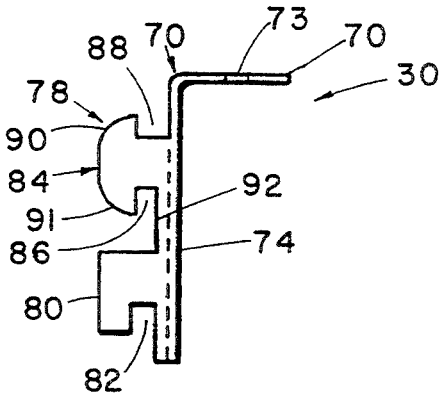
FIG. 7 is a side view of the top bracket shown in FIG. 6.
Figure 6:
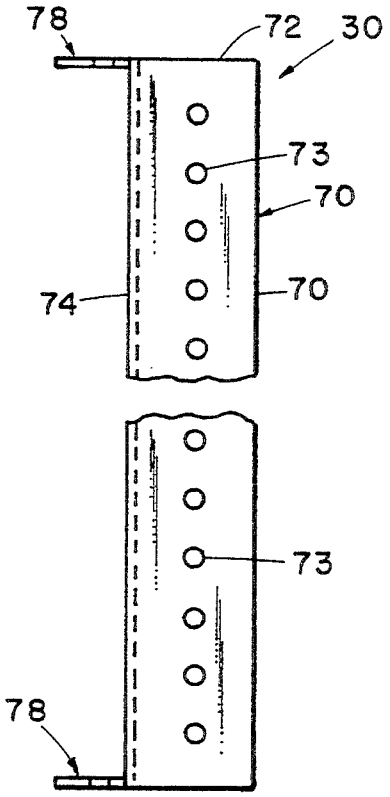
FIG. 6 is a fragmentary top view of the top bracket shown in FIG. 1.

Top bracket 30 (FIGS. 6 and 7) includes an L-shaped center portion 70 having a first leg 72 with spaced divider locating holes 73 therein, and a second leg 74 that stabilizes first leg 72. Holes 73 are adapted to receive fasteners or divider stabilizing pins 76 (FIG. 1), so that fasteners 76 engage holes 66 to secure upright dividers 22 to top bracket 30. Fasteners 76 can be screws if desired. A pair of teeth 78 extend perpendicularly rearwardly from each end of second leg 74 of center portion 70. The upper tooth 84 includes both a downwardly facing notch 86 adapted to engage an adjacent slot 46, and also includes an upwardly facing notch 88 adapted to lock into the slot. The outer corners 90 and 91 of upper tooth 84 are rounded to facilitate installation. Lower tooth 80 includes a downwardly facing notch 82 adapted to engage a first selected slot 46. A web 92 connects teeth 80 and 84 to each other for stability.

Figure 2:
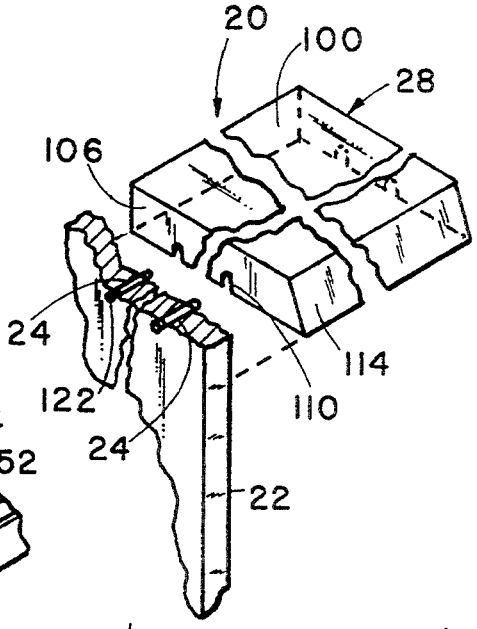
FIG. 2 is an exploded fragmentary perspective view of a shelf and an upright divider, the divider being broken away to expose the pins for attaching the shelf to the divider.

Top bracket 30 is installed by inserting upwardly facing notch 88 of upper tooth 84 into a selected slot 46 (FIG. 1). Top bracket 30 is then rotated downwardly until lower tooth 80 (FIG. 7) is positioned in an adjacent (lower) slot 46. Top bracket 30 is then dropped vertically downwardly so that both downwardly facing notches 82 and 86 (i.e. teeth 80 and 84) engage slots 46. With divider stabilizing pins 76 (FIG. 1) inserted through hole 73 into divider hole 66, top bracket 30 cannot be rotated to a release position. Thus, once assembled, top bracket 30 cannot be removed from shelving back 38 since second leg 74 frictionally abuts divider 22 on the rear side. Thus, the tipper ends of upright dividers 22 are securely interconnected and retained to top bracket 30, and also dividers 22 are securely attached to top bracket 30.

Figure 5:
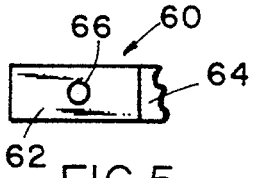
FIG. 5 is an enlarged fragmentary top view of the divider shown in FIG. 4.

Locator 34 (FIGS. 5, 8 and 9) includes an elongated upwardly facing U-shaped section 94 for receiving the lower end or bottom 95 of an upright divider 22. A pair of protrusions 96 extend downwardly from U-shaped section 94 and are adapted to engage selected holes 52 and 54 in base 36 (FIG. 1). Notably, U-shaped section 94 can be any length desired. As shown in FIG. 1, U-shaped section 94 extends to the depth of upright dividers 22, however, is it contemplated that locator 44 might only be a couple of inches long, such that a front and rear locator would then be required. Protrusions 96 on locator 34 (FIG. 8) are offset with respect to the symmetrical center line 97 of locator 34. This allows locators 34 to be used even if the locator is to be used at the end of a base 36 or where two bases 36 and 36' are abuttingly positioned adjacent each other to form a joint 98.

It is desirable to maintain the four foot span of display system 20 from end-to-end of the display system 20 so that there are no spacing problems of the display system 20 relative to the conventional gondola shelving 28. For this purpose, a special upright divider 23 (FIG. 8) can be used as an end panel. Special upright divider 23 is half the thickness of a "standard" upright divider 22. For example, if upright divider 22 is $\frac{3}{4}$ of an inch thick, then special upright divider 23 would be $\frac{3}{8}$ of an inch thick. This allows display system 20 to terminate with an outer end-to-end dimension located exactly at the four foot marks on center lines 97 such as at joint 98. In turn, this allows the display system 20 to be positioned abuttingly adjacent a second display system 20 while still exactly maintaining the four foot centerline spans. Notably, two of dividers 23 (and 23') can be positioned adjacently in U-shaped section 94 of locator 34. Further, additional thicknesses of dividers can be provided, such as an extra thin 3/16 inch thick divider. Extra thin dividers can be used where it is important to maintain a clean thin line when displaying goods on the display system. This also allows for a savings in material cost.

Figure 10:
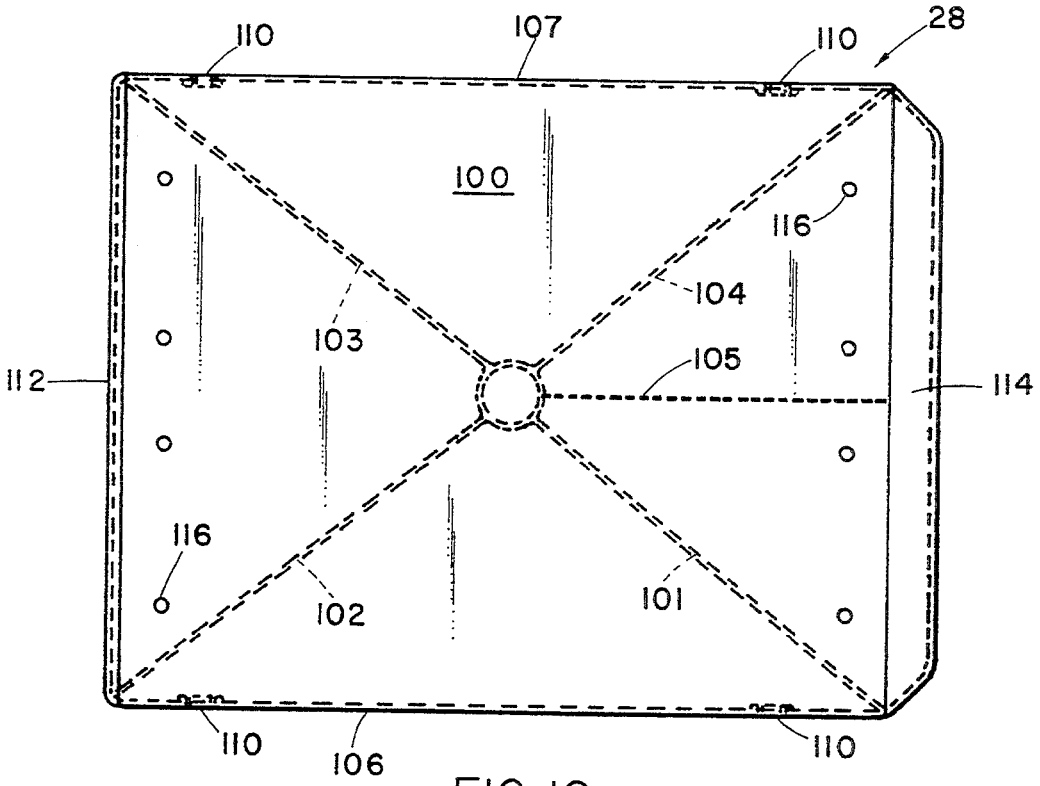
FIG. 10 is a plan view of the shelf shown in FIG. 1.

Shelves 28 (FIGS. 10 and 11) are generally rectangular and include a planar midsection 100 supported by ribs 101, 102, 103, 104 and 105. Opposing side flanges 106 and 108 extend perpendicularly downwardly and include front and rear notches or recesses 110 adapted to engage pins 24 and/or 25. A front flange 112 extends at an angle from perpendicular to planar midsection 100, and a rear flange 114 extends at a slightly lesser angle from perpendicular to planar midsection 100. Front and rear flanges 112 and 114 are angled for aesthetics and also to facilitate molding of shelves 28. Also, front and rear flanges 112 and 114 stabilize side flanges 106 and 108. Holes 116 are located in planar midsection 100 such as for securing auxiliary dividers or "fences" (not shown) or other items to shelves 28.

Figure 11:
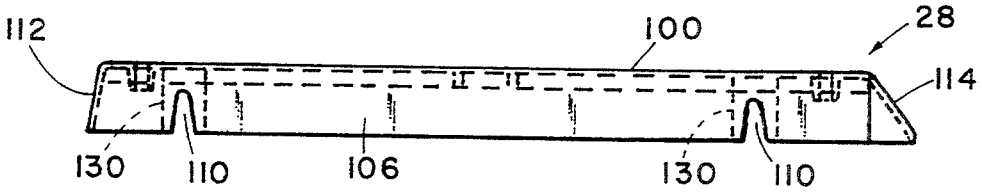
FIG. 11 is a side view of the shelf shown in FIG. 10.
Figure 11A:
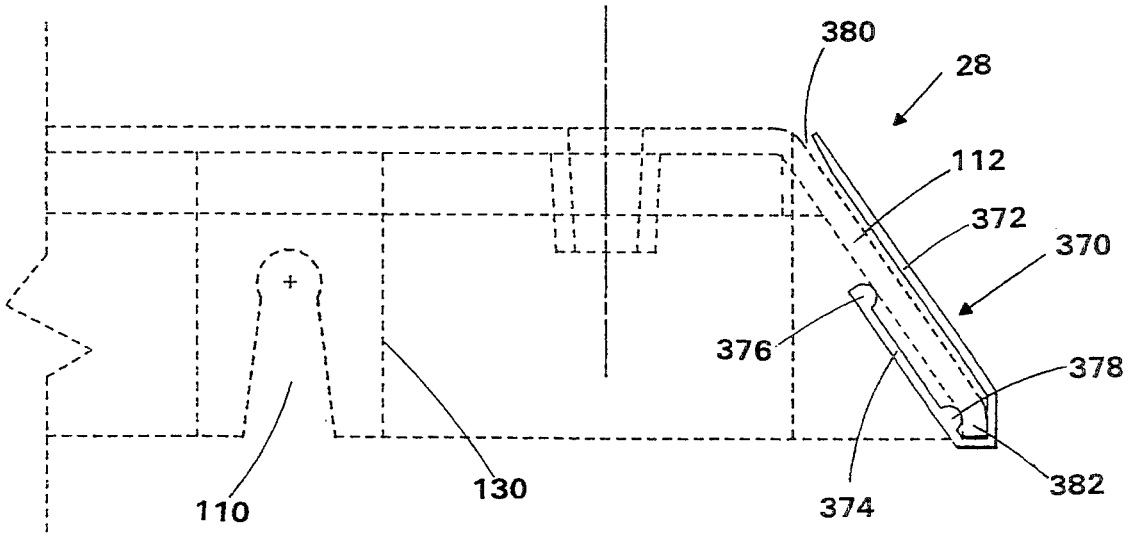

Advantageously, front flange 112 can be frictionally engaged by an extruded label retainer 370 (FIG. 11A). Label retainer 370 is C-shaped and includes a front leg 372 and a rear leg 374 that define a throat or opening 380. Ridges 374 and 376 on rear leg 374 engage shelf front flange 112 to retain label retainer 370 on front flange 112. In particular, ridge 374 engages a slightly hooked end 382 on front flange 112 to provide a secure connection. Price labels (not shown) can be inserted into opening 380 between front leg 372 and shelf front flange 112. Label retainer 370 is made of a clear material so that the label can be viewed through leg 372.

Figure 12:
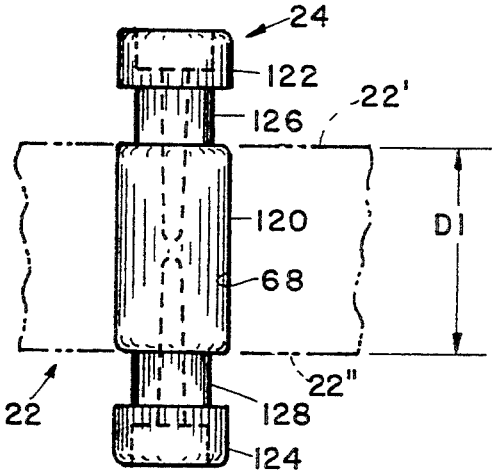
FIG. 12 is a side view of one style shelf supporting pin.

Shelf supporting pin or fastener 24 (FIGS. 2 and 12) includes a body or shaft 120 with opposing protruding ends 122 and 124. A ring-shaped depression 126 is defined between end 122 and body 120, and a similar ring-shaped depression 128 is defined between end 124 and body 120. The length D1 of body 120 is the same as the thickness of standard upright divider 22 so that depressions 126 and 128 are positioned adjacent and protruding from upright divider sides 22' and 22'' when pin body 120 is positioned in hole 68. With pins 24 located in upright divider holes 68 (FIG. 2), a shelf 28 can be positioned so that notches 110 in shelf side flanges 106 (and 108) engage ring-shaped depressions 120 (and 128). With a sharp downward blow, shelves 28 are frictionally pressfit onto pin 24 to securely retain shelf 28 thereon. Notably, side flanges 106 and 108 are about $1\frac{1}{4}$" deep so that they have sufficient distance to stably engage upright divider side 22' (and 22''). A ridge 130 on the inside of side flanges 106 and 108 around notches 110 provides increased strength to side flanges 106 and 108 in the area of notches 110.

Figure 13:
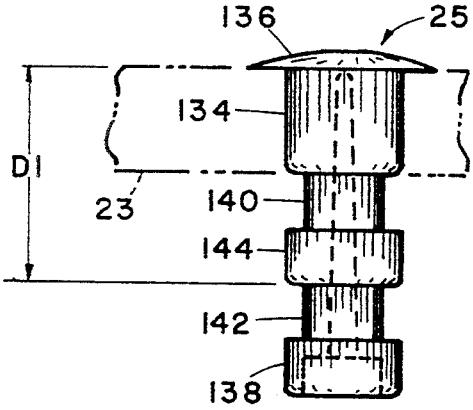
FIG. 13 is a side view of a second style shelf supporting pin.

Shelf supporting pin or fastener 25 (FIG. 13) is intended for use on an upright divider 23 located at an end of divider system 20, or on a divider 22 where two shelves 28 are not positioned at the same height on the opposite sides of the divider 22. Pin 25 includes a body 134 with a head 136 at one end and a protruding end 138. Two ring-shaped depressions 140 and 142 are defined between body 134 and end 138, the ring-shaped depressions being separated by a ridge 144 that is the diameter of body 134. Pin 25 can be extended through hole 68 in upright divider 22 with head 136 engaging one side of the upright divider, and the outer ring-shaped depression 142 extending out of the other side of the upright divider 22. In this configuration, body 134 and ridge 144 are located within hole 68. Shelf side flange notch 110 call be frictionally pressfit onto outer ring-shaped depression 142. Pin 25 can also be used on the half thickness upright divider 23. With pin 25 positioned in hole 68 in half thickness upright divider 23, ring-shaped depression 140 is positioned outside of hole 68 whereat inner ring-shaped depression 140 can be frictionally engaged by shelf side flange notch 110. Similarly, pins 24 and 25 can be further adapted to receive a panel of 3/16 inch thickness by the addition of additional ring-shaped depressions (not shown).

To assemble display system 20, top bracket 30 is initially positioned on conventional gondola shelving back 38 with top bracket teeth 78 engaged with support slots 46 at a selected height. Also, locators 34 are positioned as desired on conventional gondola shelving base 36 with locator protrusions 96 engaging selected base holes 52 and 54. Upright dividers 22 are then positioned in locators 34, and divider stabilizing pins 76 are extended downwardly through top bracket holes 66 into divider top holes 66. Dividers 22 are thus temporarily semistably located on conventional gondola shelving 28.

Shelf supporting pins 24 and 25 are then inserted into shelf supporting holes 68 in dividers 22 as desired. Specifically, pins 24 are utilized at locations where there will be shelves at equal height on opposing sides of a divider 22 (see FIGS. 1 and 2). Pins 25 are utilized at locations where there will be a shelf 26 on one side but not on the other side of a divider 22, or where a divider 23 will be used. With pins 24 and 25 inserted, shelves 26 are positioned between adjacent dividers 22 (see FIGS. 1 and 2), each shelf 26 having two of pins 24 (or 25) supporting each side flange 106 (or 108) at notches 110. Shelf notches 110 can be fully frictionally seated onto pins 24 (and 25) by a sharp downward blow on the shelf 26. This positions shelf pin flanges 106 (and 108) against divider sides 22' (and 22'') and thus stabilizes display system 20.

Several modified display systems and modified components embodying the present invention are contemplated. In these modifications, comparable components and features are identified by identical numbers, but with letters "A", "B", "C" and etc. added thereto. This is intended to reduce redundant discussion.

A modified gondola shelving base 37A (FIG. 3) can be installed onto support back 28 above display system 20. Base 37A is formed comparably to base 36 insofar that it includes a comparable upper surface 50A with holes 52A and 54A therein. However, base 37A includes hooks or teeth 150A adapted to engage selected slots 46. Thus, base 37A can be positioned at any height, such as on top of or above lower display system 20. It is contemplated that the lower display system can be designed so that lower dividers 22 include a top surface adapted to abuttingly engage base 36A to support the weight of an upper display system 20A, or alternatively the upper display system 20A (i.e. alternative base 37A) can be designed so that there is limited or no contact between base 36A and lower dividers 22.

Figure 3:
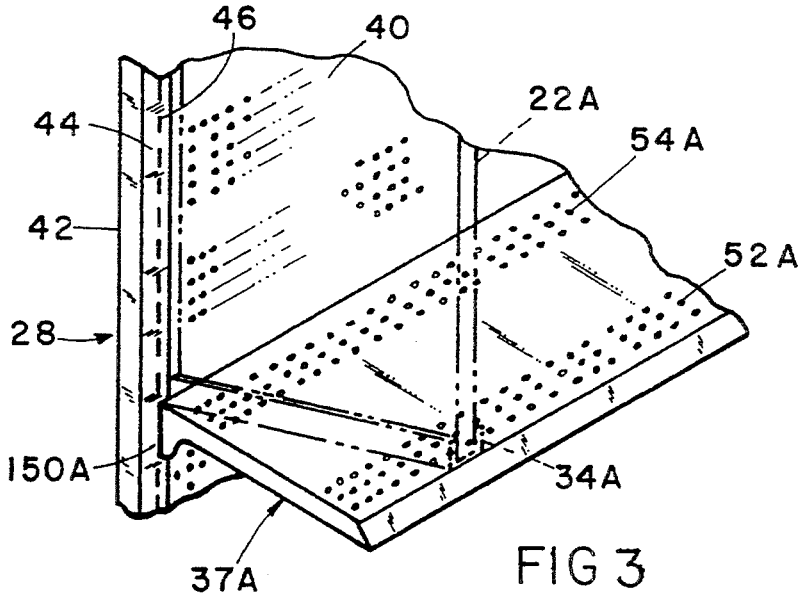
FIG. 3 is a perspective view of an alternative base attached to the conventional gondola shelving back.

Another modification is illustrated in FIG. 3. It is contemplated that one of the protrusions 96 (FIG. 9) on locator 34 can be snipped off thus allowing locator 34A to rotate 360°, in plan view so that locator 34A can thus be positioned at any angle desired relative to base 37A (or base 36) and back 38. Thus a divider 22A retained thereon is located at a desired angle. In such case, special shelves (not shown) in the shape of a parallelogram with appropriately positioned shelf side flange notches 110 would be required, however the shelves would be otherwise generally as disclosed above. Also, it is contemplated that shelf supporting holes 68 can be located in a non-horizontally paired, staggered arrangement in upright divider 22 so that shelf 26 is retained at an angle to horizontal. Alternatively, shelves 28 can be manufactured with notches arranged so that when installed on horizontally paired shelf supporting holes 68, the shelf is retained at a desired angle.

Figure 14:
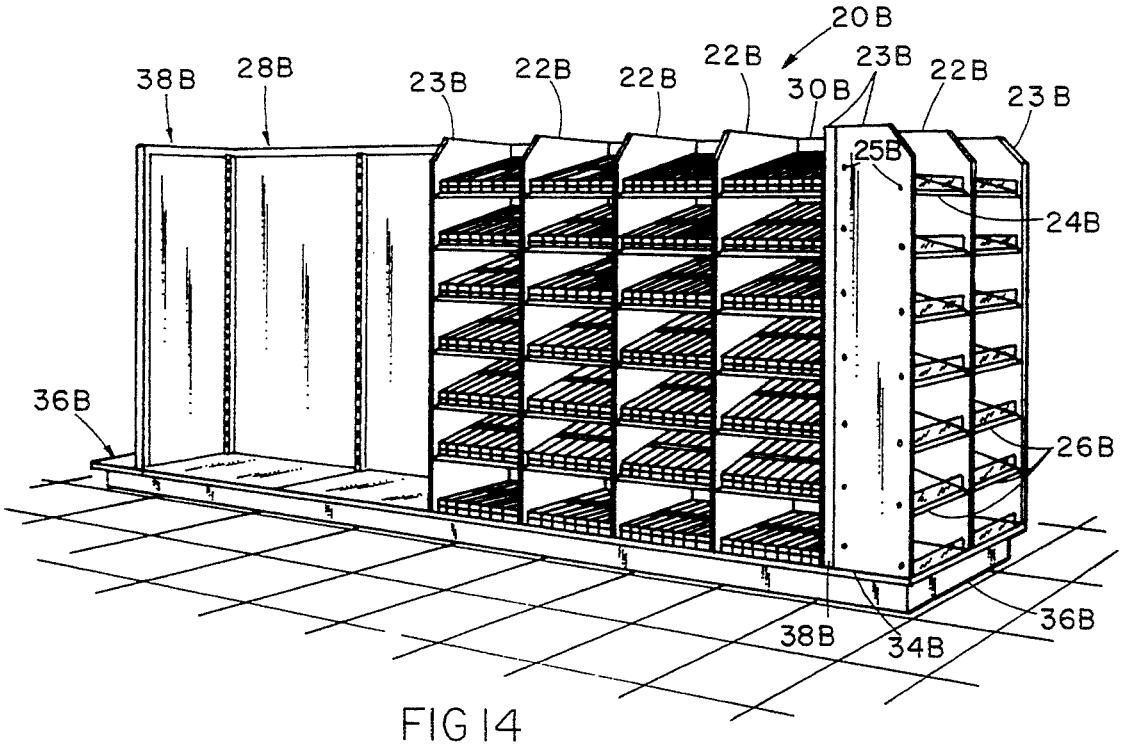
FIGS. 14–16 are perspective views of various arrangements of the display system.
Figure 15:
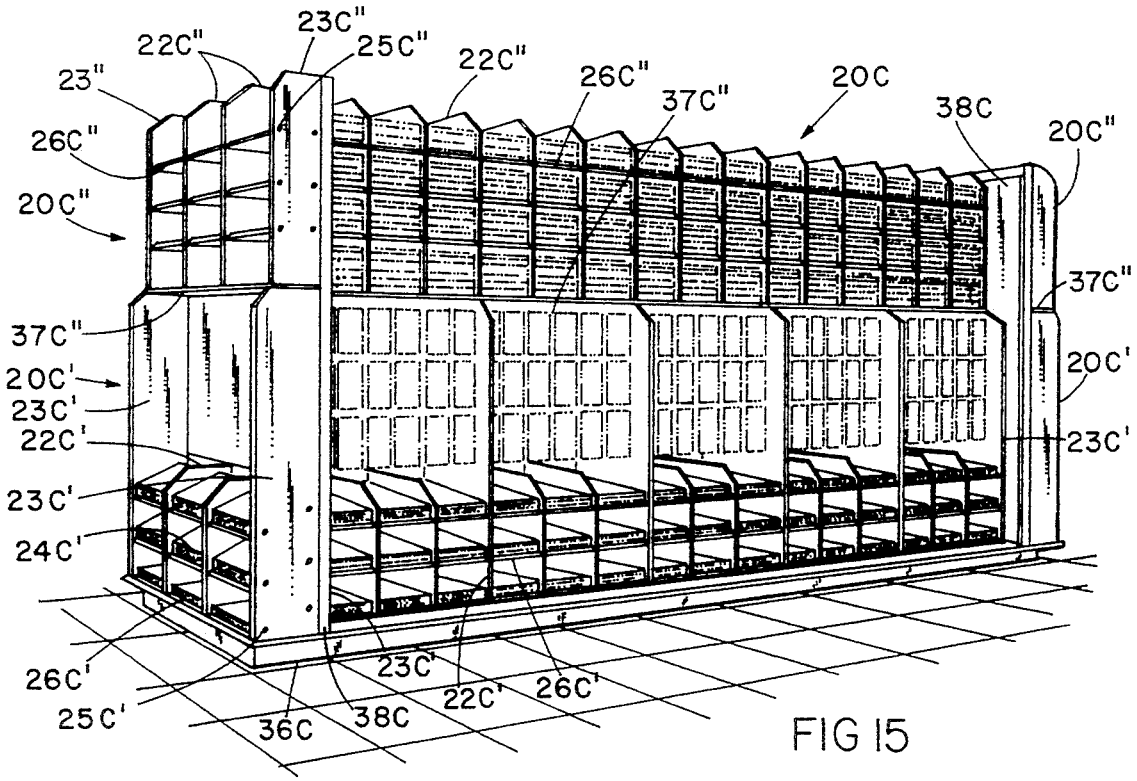
Figure 16:
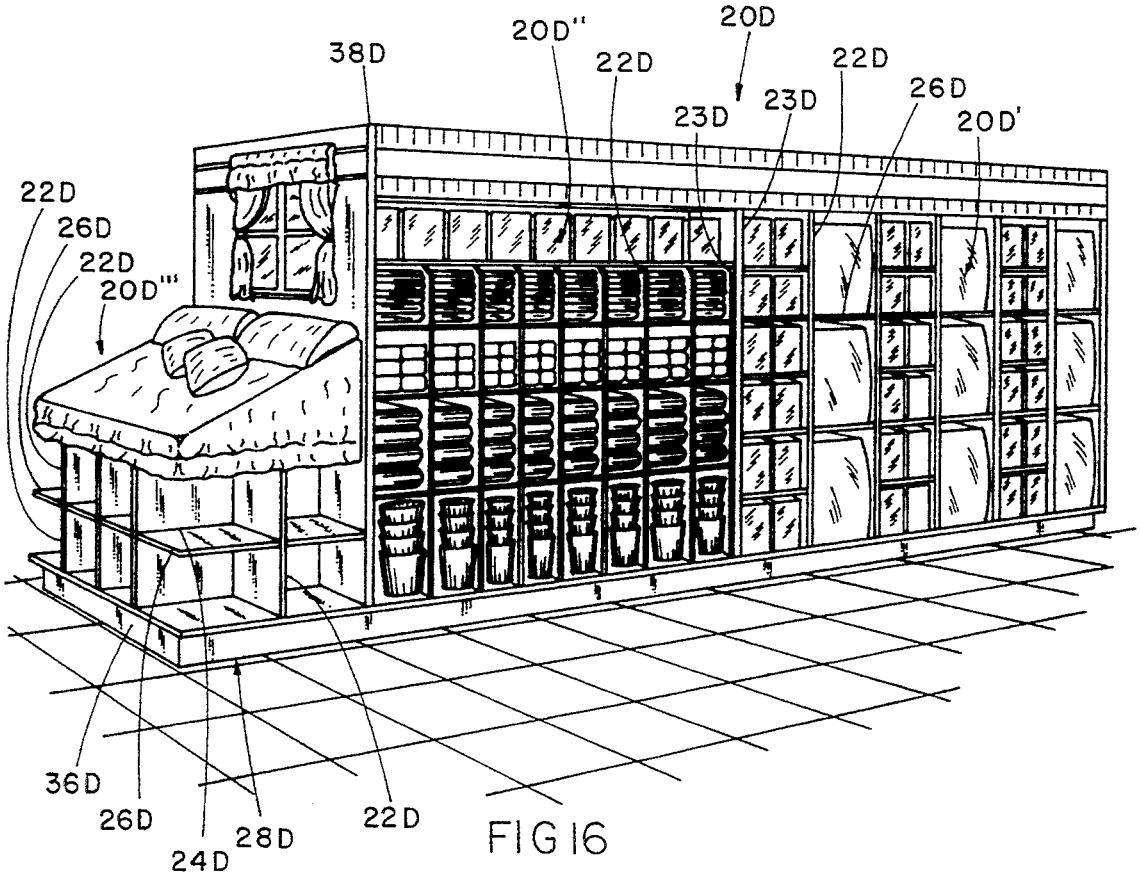

Three arrangements of the display system are shown in FIGS. 14-16, and generally referred to by numbers 20B, 20C and 20D respectively. Comparable features and components to display system 20 are designated by use of the same number plus the letters "B", "C" and "D". In display system 20B (FIG. 14), dividers 22B are located by top bracket 30B and locators 34B, and are interconnected by inclined shelves 26B. The ends of display system 20B are formed by half thickness dividers 23B with pins 25B extended therethrough. The intermediate dividers are full thickness dividers 22B, with pins 24B (not specifically shown in FIG. 14) extended therethrough. Shelves 26B are pressed downwardly to frictionally engage pins 24B and 25B. Notably, the pairs of shelf supporting holes (68B) in dividers 22B and 23B are located non-horizontally so that pins 25B (and 24B) are located non-horizontally and thus shelves 26B are retained in an inclined or angled position.

Display system 20C (FIG. 15) includes a lower display system 20C' and an upper display system 20C''. Lower display system 20C' includes dividers 22C' and 23C' interconnected by pins 24C' and 25C' and shelves 26C'. Upper display system 20C'' includes dividers 22C'' and 23C'' interconnected by pins 24C'' (and 25C'') and shelves 26C''. Lower display system 20C' is supported by shelving base 36C, and upper display system 20C'' is supported by shelving base 37C''.

Display system 20D (FIG. 16) illustrates yet another embodiment wherein the shelves 26D are irregularly positioned across half of the width of the display system (generally referred to by number 20D'), and are regularly positioned along the other half 20D'' Also, an end display 20D''' is positioned at an end of the conventional gondola shelving 28D.

It is contemplated that the holes 25 and dividers 22 can be located in a number of different patterns and locations to facilitate placement of shelves on the dividers as desired. For example, dividers 22E (FIG. 17) are generally comparable to dividers 22, but dividers 22E include a front hole 68E' and a series of rear holes 68E''. The rear holes 68E'' are located an equal distance from front hole 68E' in an arcuate pattern. This allows pins (24 and 25) to be selectively located in holes 68E'' in panels 22E so that shelves (26) can be held at a desired angular orientation when installed. For example, shelves can be held in any of the planes 151E extending between holes 68E' and 68E''. This angularity is desirable when displaying merchandise so that the merchandise is viewed at an optimal angle by a consumer standing adjacent the display system.

Figure 18:
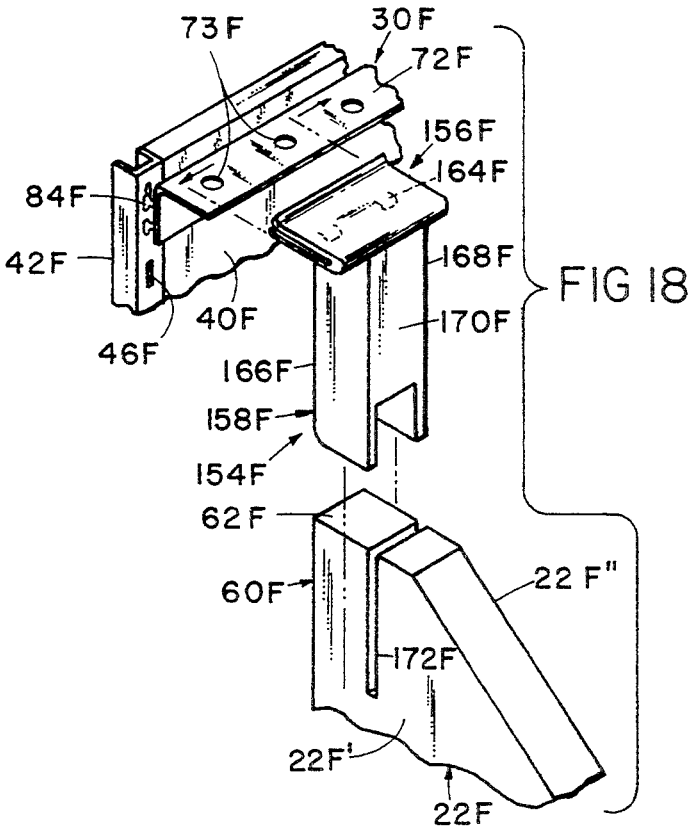
FIG. 18 is an exploded perspective view of another modification of the display system, the modification including a releasably engageable anchor bracket.
Figure 19:
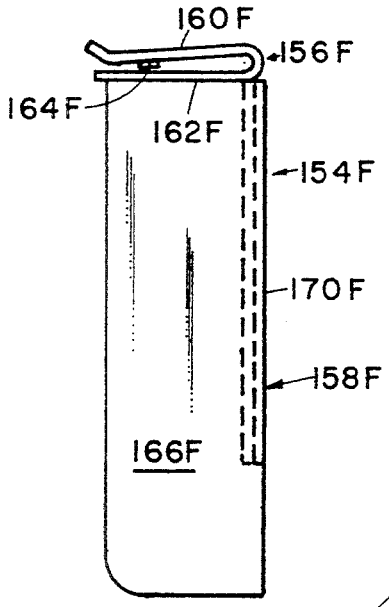
FIG. 19 is a side view of the anchor bracket illustrated in FIG. 18.
Figure 20:
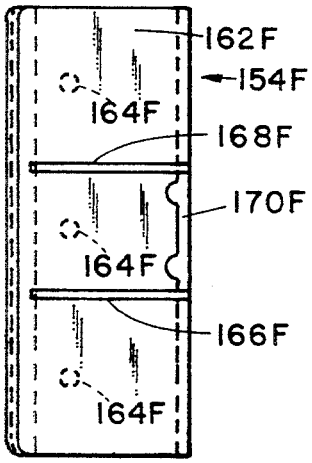
FIG. 20 is a bottom view of the anchor bracket illustrated in FIG. 18.

Another modification is illustrated in FIG. 18. In FIG. 18, pin 76 is replaced with an anchoring bracket 154F, and the upper rear corner 60F of dividers 22F are modified to receive anchoring bracket 154F. Anchoring bracket 154F (FIGS. 19 and 20) includes an upper section 156F and a lower section 158F that extends downwardly from upper section 156F. The upper section 156F has a C-shaped profile including an upper web 160F and a lower web 162F that form a throat for receiving top bracket flange 72F. A pair of protrusions 164F on upper web 160F extend into the throat, protrusions 164F being configured to securely but releasably engage holes 73F. This allows anchoring bracket 154F to be relocated horizontally along top bracket 30F to various positions as desired.

Lower section 158F (FIGS. 19 and 20) includes a pair of parallel sidewalls 166F and 168F joined by a connecting wall 170F to form a C-shaped section. Connecting wall 170F is slightly shorter than walls 166F and 168F. The upper rear corner 60F of dividers 22F (FIG. 21) are modified by a saw cut or slot 172F that extends from horizontal upper surface 62F downwardly into divider 22F a distance at least equal to the length of connecting wall 170F. Slot 172F is spaced frown the rear edge of divider 22F. Connecting wall 170F fits mateably into slot 172F with anchor bracket walls 166F and 168F engaging the sides 22F' and 22F'' of divider panel 22.

Figure 8:
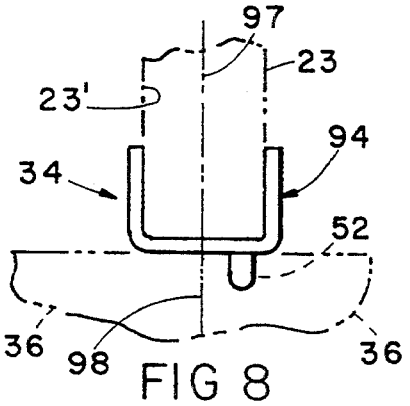
FIG. 8 is a front view of the bottom locator shown in FIG. 1.
Figure 9:
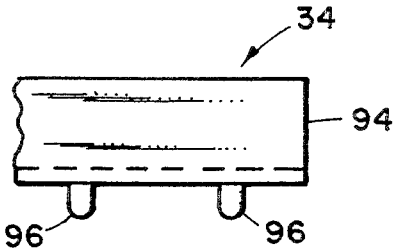
FIG. 9 is a side view of the bottom locator shown in FIG. 8.

A secondary locator bracket 176G (FIGS. 21–23) can be used to stabilize half thickness divider 23 such as at a shelving end or joint 98 (see FIG. 8). Secondary locator bracket 176G includes a U-shaped section 178G adapted to engage a rear edge of a divider 23G, and further includes a pair of offset protrusions 180G. Protrusions 180G are shaped to mateably engage slots (46) in the anchor rails (42) of the conventional gondola shelving. With protrusions 180G engaged in slots (46), U-shaped section 178G prevents dividers 23G from slipping horizontally over or into a joint (98). Thus, even if the bottom of divider 23G is kicked by an operator, it cannot flex or bend out of position and drop over and into a joint (98). Thus, secondary locator bracket 176G holds dividers 23G in a vertically flat plane so that dividers 23G do not buckle and collapse.

Figure 24:
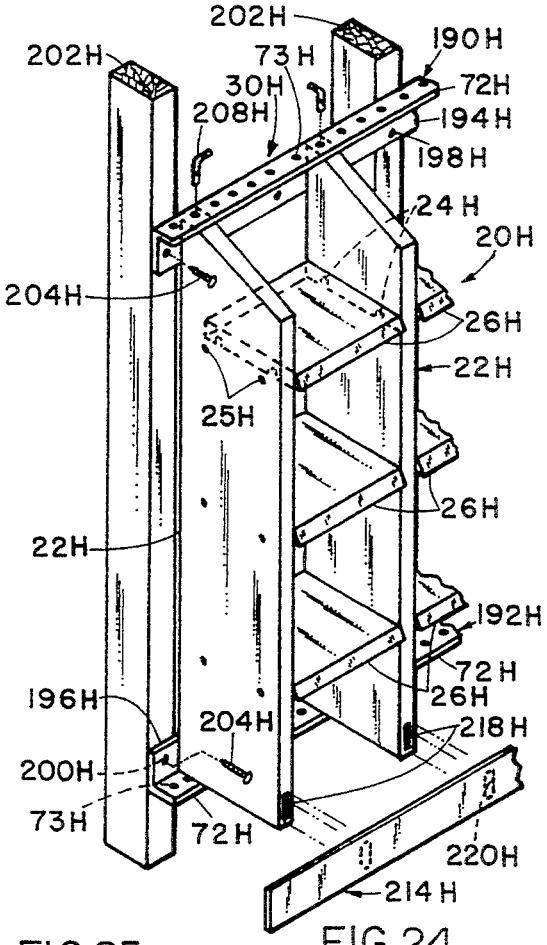
Figure 26:
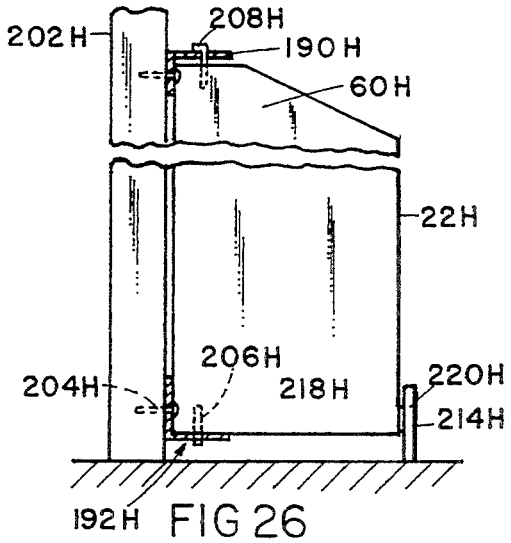

Another modification of the display system embodying the present invention is contemplated which allows the display system to be installed on any wall or similar structure. Display system 20H (FIGS. 24 and 25) includes a pair of identical L-shaped brackets 190H and 192H. Brackets 190H and 192H include a first vertically oriented leg 194H and 196H, respectively, with holes 198H and 200H therein, respectively. Holes 198H and 200H are optimally spaced about 16" apart so that they can be alighted with 2×4 wooden studs 202H in a conventionally studded wall of a building. Brackets 190H and 192H can thus be secured by fasteners 204H to studs 202H. Brackets 190H and 192H further include a second laterally extending leg 72H with anchoring holes 73H located along their lengths.

Figure 25:
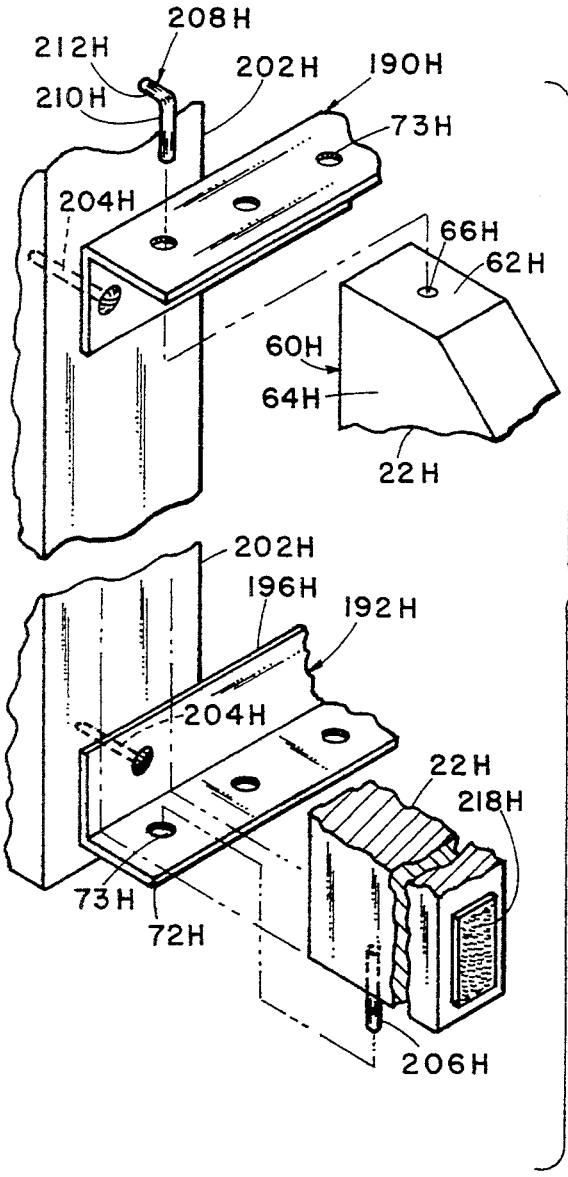

The lower rear corner of dividers 22H (and 23H) are modified to include a downwardly extending protruding pin 206H (FIG. 25). Pin 206H is shaped to securely engage a selected hole 73H in bottom bracket 192H. The upper rear corner of 60H of divider 22H includes a hole 66H. A headed pin 208H includes a first section 210H adapted to extend through a selected hole 73H in top bracket 190H, and further includes an enlarged second section 212H that cannot slide through hole 73H and that acts as a handle to facilitate inserting or removing pin 208H.

Shelves 26H are installable onto and between dividers 22H as previously described in reference to display system 20.

One or more elongated stabilizing panels or cross pieces 214H (FIGS. 24 and 25) are secured to dividers 22H. Cross piece 214H, for example, can be used as a kick panel-to improve aesthetics as well as to perform the function of stabilizing display system 20H. In the embodiment disclosed, cross piece 214H is releasably secured to the front edge of dividers 22H by mating patches 218H and 220H of hook-and-loop material, such as Velcro ®. It is contemplated that the hook-and-loop material can be extended the full length of cross piece 214H thus facilitating positioning dividers 22H in any spaced apart condition desired.

Figure 27:
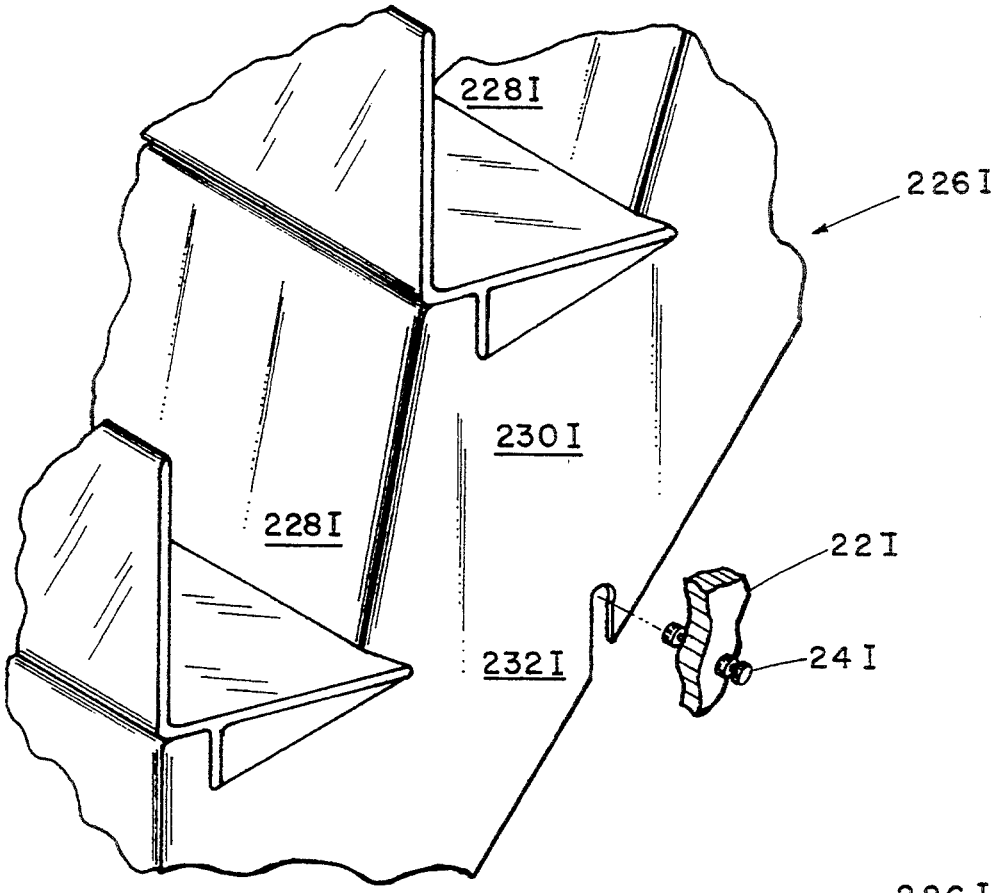
Figure 28:
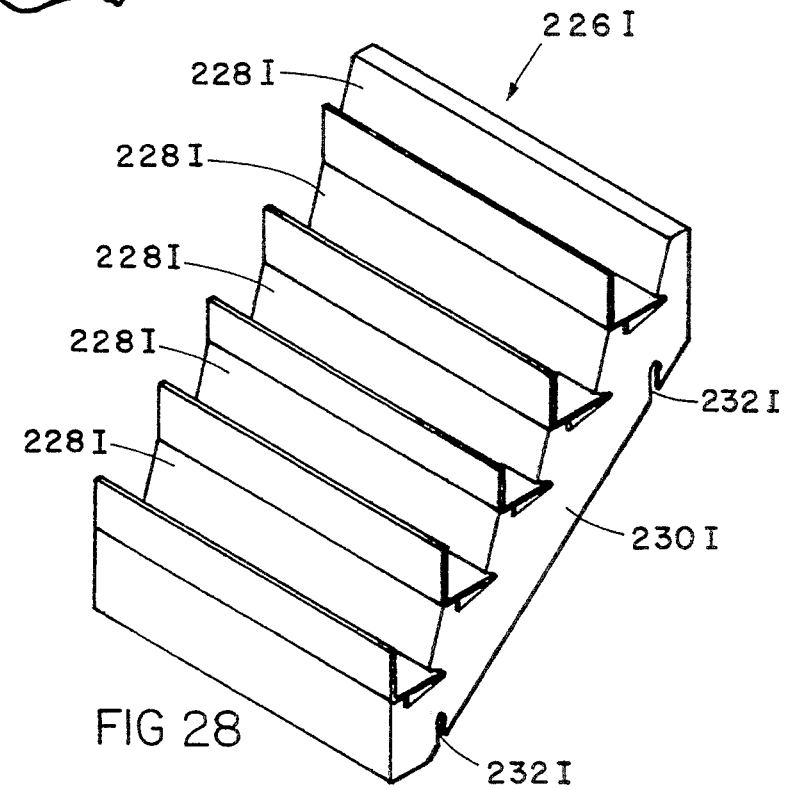

It is contemplated that a number of different shelves can be attached to dividers 22–22H. In FIGS. 27 and 28, there is a shown a vacuum formed shelf 226I having multiple cascadingly positioned pockets 228I such as for holding and displaying greeting cards. The sides 230I of shelf 226I are notched with notches 232I. Notches 2321 are shaped to securely engage pins 24I (and 25I), which pins can be selectively located in holes (68) of dividers 22I (and 23I). It is contemplated that additional specialty shelves can be readily constructed for specialized needs, such as for incorporating spring assisted forward feeding mechanisms such as for cigarettes and similar small packages.

Figure 30:
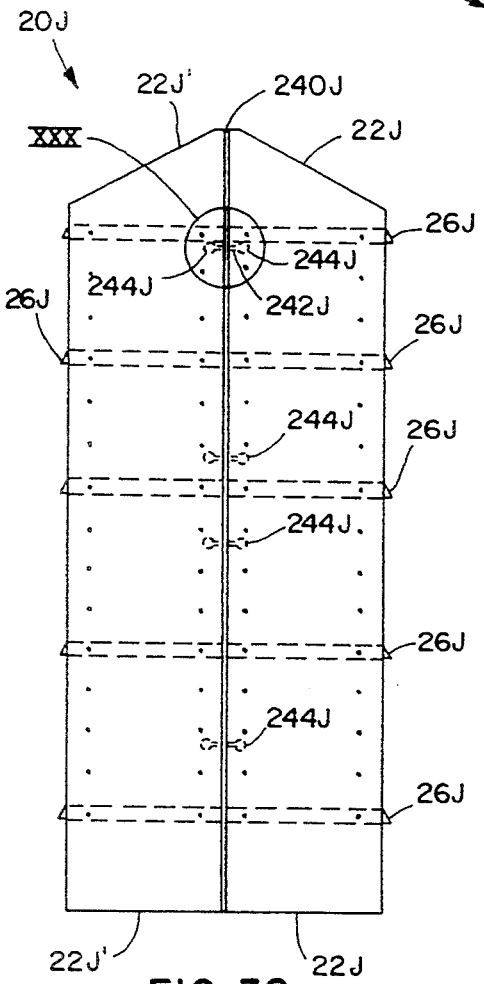
FIG. 30 is a side view of the display system shown in FIG. 29.
Figure 29:
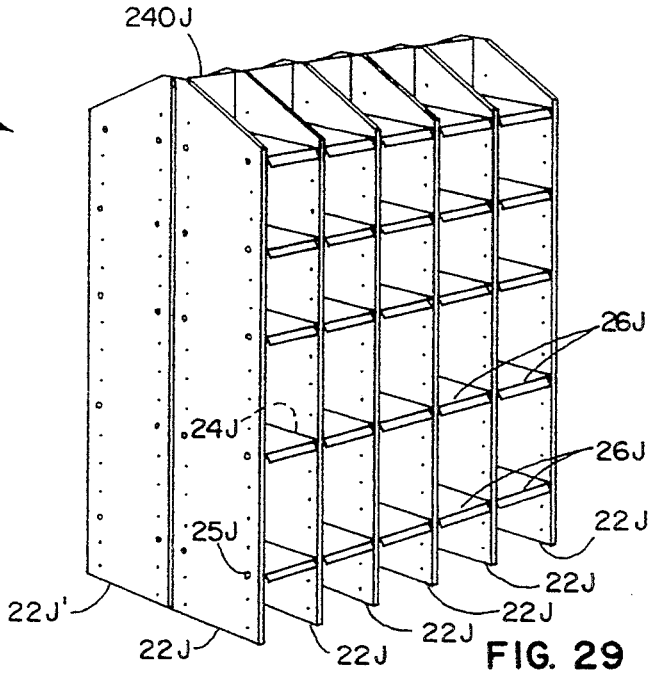
FIG. 29 is a perspective view of a modified fleestanding display system embodying the present invention, the display system being freestanding and shelf supporting.
Figure 31:
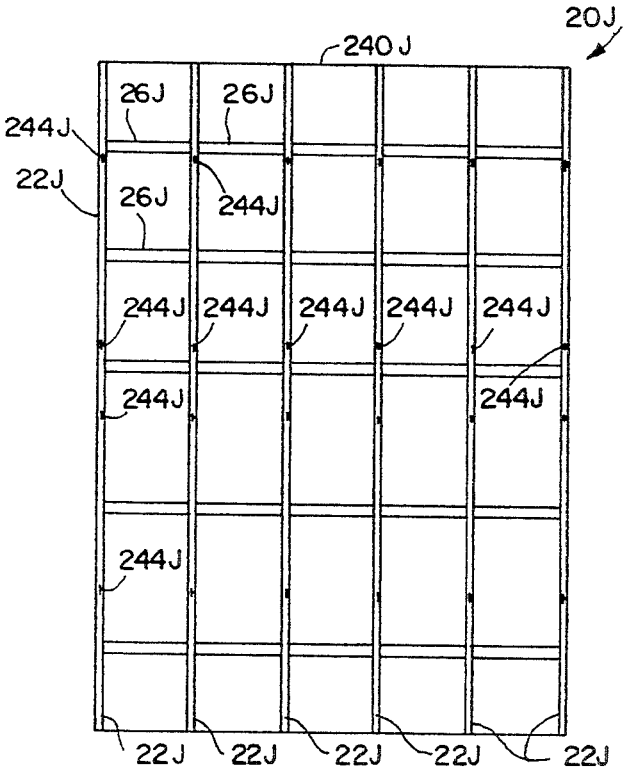
FIG. 31 is a front view of the display system shown in FIG. 29.

Another modification of the display system embodying the present invention is freestanding and is generally referred to as display system 20J. The display system 20J (FIGS. 29–31 ) includes dividers 22J and 22J', shelf supporting pins or fasteners 24J, 25J and shelves 26J that engage the pins and dividers in a manner identical to comparable components on display system 20. To reduce redundant discussion, the engagement of shelves 26J on pins 24J and the engagement of shelf supporting pins 24J on dividers 22J will not be repeated. However, display system 20J further includes a back panel 240J and connectors 242J (FIG. 32) that extend through back panel 240J into dividers 22J and 22J' positioned on opposite sides of back panel 240J. Disk-shaped retainers 244J are located in dividers 22J and are rotatable to engage connectors 242J to draw dividers 22J into compressive engagement with back panel 240J. A plurality of connectors 242J and retainers 244J can be used, depending upon the thickness and stiffness of back panel 240J and the rigidity required of display system 20J.

Figure 32:
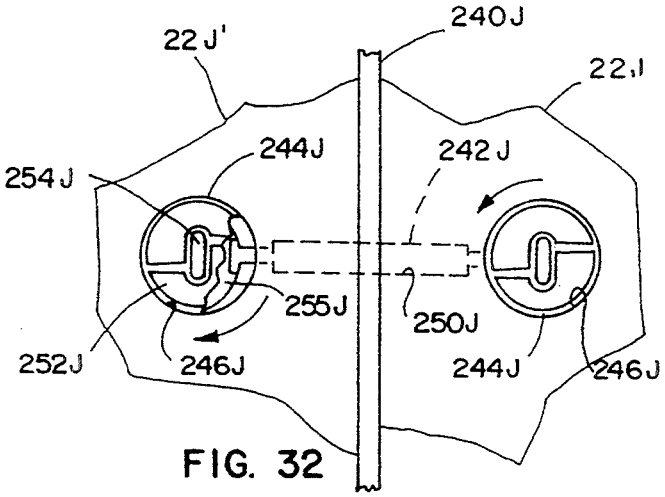
FIG. 32 is an enlarged partially broken-away view of the circled area XXX in FIG. 30.
Figure 32C:
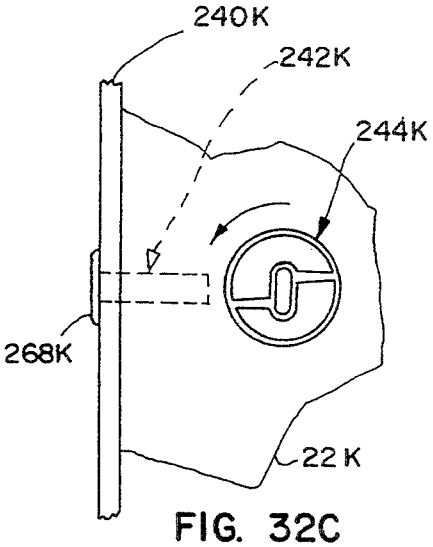
FIG. 32C is an enlarged, fragmentary view comparable to FIG. 32 but showing a modified display system using a modified connector and having dividers and shelves on only one side of a back panel.
Figure 32A:
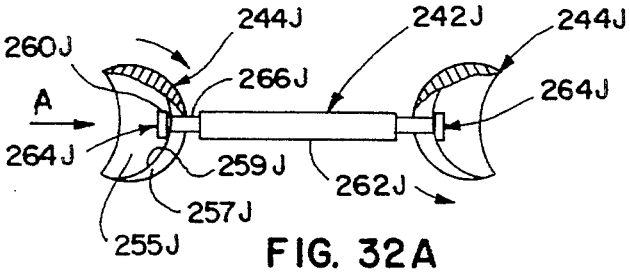
FIG. 32A is a partially broken away view of the connector and retainer arrangement shown in FIG. 32.
Figure 32B:
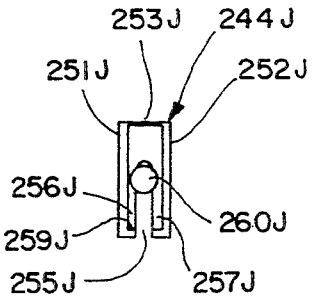
FIG. 32B is an end view of the retainer taken in the direction "A" in FIG. 32A.

Connectors 242J and retainers 244J are most clearly shown in FIGS. 32, 32A and 32B. Dividers 22J include one or more holes 246J bored perpendicularly into the side of dividers 22J a predetermined distance from rear edge 248J of dividers 22J. A second hole 250J is drilled from rear edge 248J into first hole 246J, second hole 250J being a substantially smaller diameter than hole 246J. Retainers 244J (FIGS. 32A and 32B) include a pair of disk-shaped bodies 251J and 252J secured together by a web 253J. A slot 254J (FIG. 32) on the side of body 252J is engageable by a standard screw driver so that retainer 244J is rotatable in hole 246J. Side bodies 251J and 252J define a space 255J therebetween. Circumferentially extending ledges 256J and 257J extend into space 255J from side bodies 251J and 252J and define a T-shaped slot in space 255J therebetween. Ledges 256J and 257J each include an inclined surface 259J that ramps toward the center of retainer 244J as retainer 244J is rotated. Connectors 242J include a shaft 262J and a pair of configured ends 264J having a ring-shaped slot 266J. Configured end 264J has a T-shaped profile with an enlarged end 260J shaped to mateably engage slot 255J. The inclined surface 259J of ledges 256J and 257J engage configured end 264J so that as retainer 242J is rotated, connector 242J is drawn toward the axial center of retainer 244J. Since retainer 244J is positioned in hole 246J (in divider 22J), this causes opposing dividers 22J and 22J' to be drawn compressively against back panel 240J. The compressive forces rigidify display system 20J.

Figure 32D:
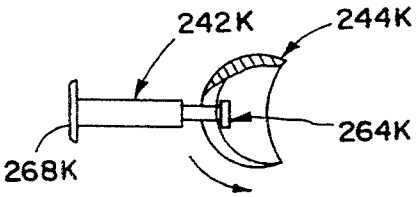
FIG. 32D is a partially broken away view of the connector and retainer arrangement shown in FIG. 32C.

In FIGS. 32C and 32D, there is shown a modified connector 242K. Like connector 242J, connector 242K includes a configured end 264K at one end of the shaft 262K. However, connector 242K has a flat head 268K allowing it to engage a back side of back panel 240K. Thus, a freestanding display system (20K) is possible having dividers (22K) and shelves (26K) on only one side.

Figure 17:
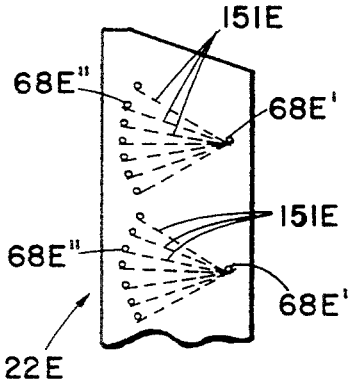
FIG. 17 is a side view of a modified divider panel embodying the present invention.
Figure 33:
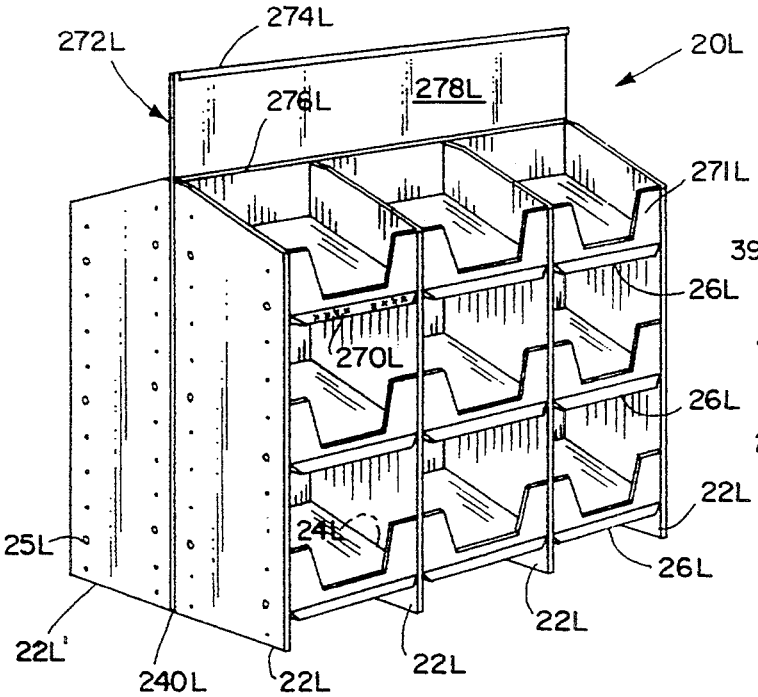
FIG. 33 is a perspective view of another modified display system embodying the present invention, the display system including a back: panel incorporating a header.

A display stand 20L (FIG. 33) is identical to display stand 20J except that shelves 26L and back panel 240L have been modified. Shelves 26L are now oriented at an angle (previously described in this application and is shown in FIG. 17) and further, shelves 26L are modified to include a pricing channel 270L along their front edge. Shelves 26L are also modified to include a compartment divider 271L to hold product on the angled shelf. Also, back panel 240L has been extended upwardly to form a header 272L. Header 272L includes horizontally extending top and bottom C-shaped channels 274L and 276L defining a horizontal pocket for receiving a cardboard or paper graphic insert 278L. Product information, product trademarks, and the like can be printed on the insert 278L in a highly visible location.

The illustrated shelves 26L can be made from a variety of materials. In many applications, customers and/or retailers prefer a shelf made of wood, pressboard or composite materials for aesthetics. However, such materials may exhibit a durability problem since they will chip in the area that frictionally engages pins 24L and 25L, particularly if the shelves are repeatedly disassembled and reassembled. Reinforcement bracket 280L

Figure 34:
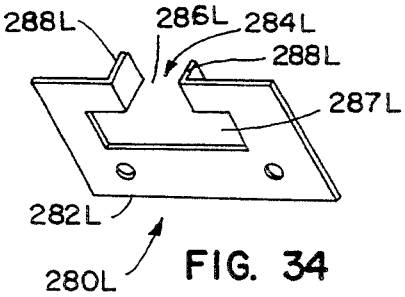
FIG. 34 is a reinforcement bracket for use with a wooden or pressboard shelf on the display system shown in FIG. 33.
Figure 35A:
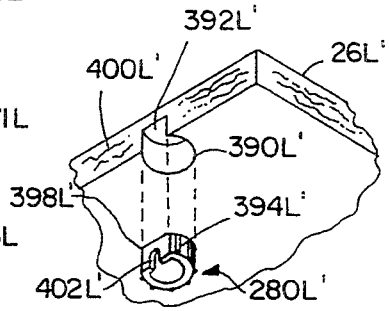
FIG. 35A is an exploded fragmentary perspective view of a wood shelf and an alternative reinforcement bracket for engaging a hole in the shelf, the reinforcement bracket being configured to frictionally engage a shelf supporting pin.
Figure 35B:
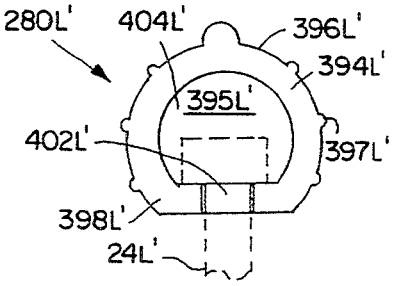
FIG. 35B and 35C are plan and side views of the reinforcement bracket shown in FIG. 35A.
Figure 35C:
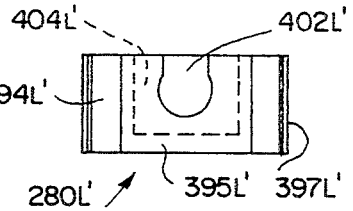
Figure 35:
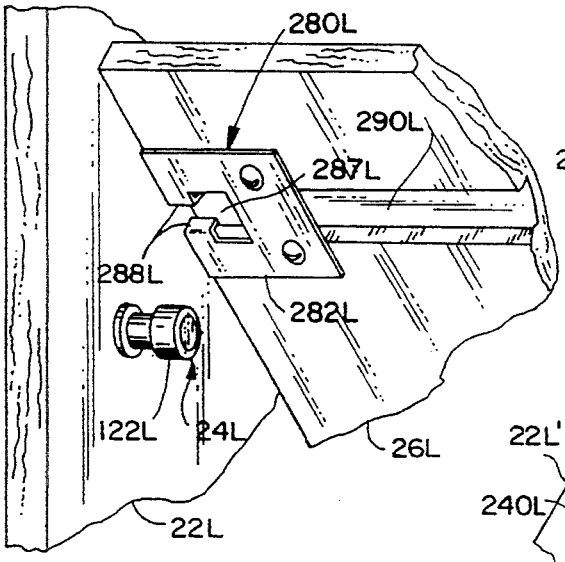
FIG. 35, is a perspective view of a shelf including the reinforcement bracket shown in FIG. 34, the reinforcement bracket being installed on a shelf and ready to engage a shelf supporting pin protruding from a divider.
Figure 36:
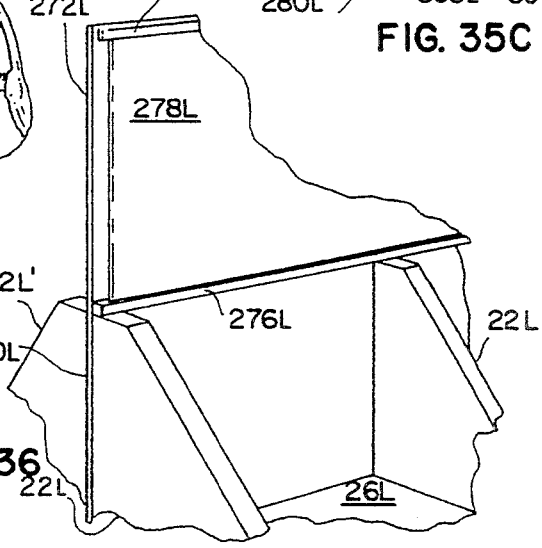
FIG. 36 is an enlarged, fragmentary, perspective view of the header of the display system shown in FIG. 33.

(FIG. 34) is provided to improve the service life (i.e. chip resistance) for shelves of these types. Reinforcement bracket 280L includes a body 282L, with T-shaped slot 284L having a narrow section 286L and a wide section 287L. Fingers 288L extend from the material of body 282L forming narrow section 286L, and extend perpendicularly to body 282L. A recess or channel 290L on the underside of shelf 26L is configured to receive the protruding end 122L of pin 24L (or pin 25L). As illustrated in FIG. 35, reinforcement bracket 280L is installed on the underside of shelf 26L over recess 290L near an edge of shelf 26L. In this position, fingers 288L extend into recess 290L and are configured to interlockingly, frictionally engage protruding end 122L on pin 24L (or 25L).

Another alternative reinforcement bracket or shelf-pin-engaging nut 280L' (FIG. 35A) is ring-shaped for engaging a hole or recess 390L' in the bottom of shelf 26L' adjacent the side of shelf 26L'. Hole 390L' includes a truncated side 392L' that opens onto the side of shelf 26L'. Bracket 280L' has a ring-shaped wall 394L' that includes a cylindrical outer surface 396L'. Surface 396L' includes ridges 397L' for pressfit nonrotatable retention in shelf hole 390L'. A bottom wall 395L' rigidities ring-shaped wall 394L'. Ring-shaped wall 394L' includes a truncated side 398L' that is positionable flush with the side surface 400L' of shelf 26L'. A notch 402L' is located in truncated side 398L'. A space 404L' is defined within ring-shaped wall 394L'. Shelf supporting pin 24L' (shown in dashed lines in FIG. 35B) frictionally engages notch 402L' in retainer 280L' to retain shelf 26L' to dividers (22L') in a system (20L').

Figure 37:
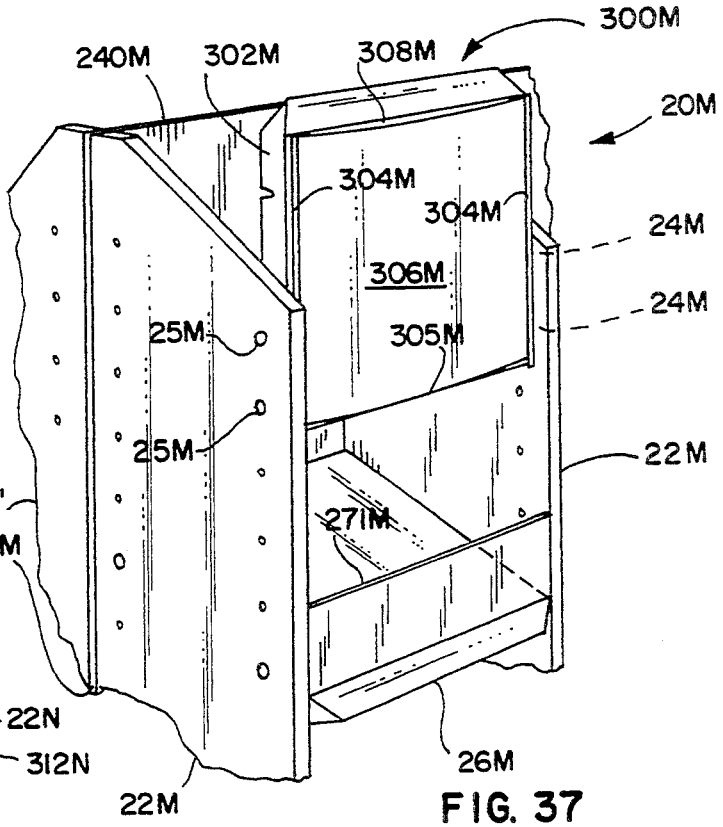
FIG. 37 is a fragmentary perspective view of another display system embodying the present invention including a specialized shelf inverted to form a header, and a graphic insert engaged with the header.

Another header 300M embodying the present invention is illustrated in FIG. 37. Header 300M is substantially the same size as a shelf and includes side edges 302M identical to the side edges of shelves 26, except that header 300M is configured to be attached to pins 24M (or 25M) with the planar face 308M of header 300M oriented vertically. Opposing C-shaped channels 304M are located on the sides of header 300M and stop 305M is located at the bottom, channels 304M defining a pocket for slideably receiving a graphic insert 306M.

Figure 38:
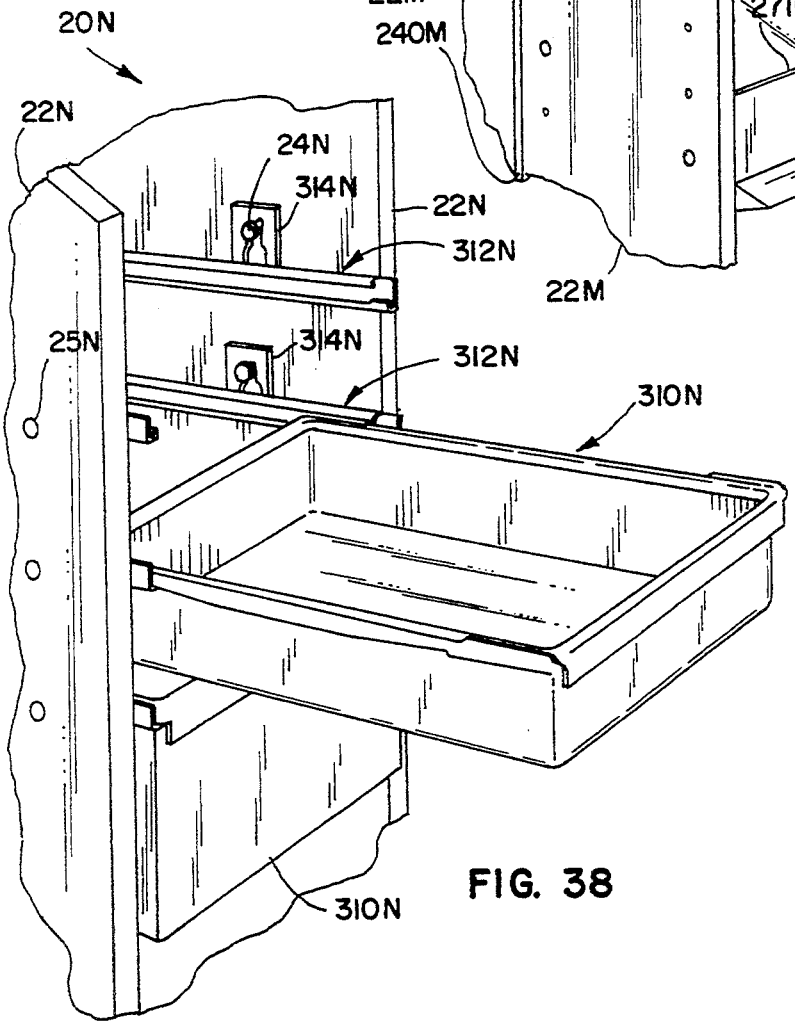
FIG. 38 is a fragmentary perspective view of another system embodying the present invention, the system including drawers.

In FIGS. 38–41, there are shown multiple display systems 20N, 20P, 20Q and 20R, respectively, which further illustrate the modularity and flexibility of the present invention. In FIG. 38, display system 20N is shown including drawer guides 312N secured on dividers 22N, and drawers 310N configured to operably slideably engage guides 312N. It is noted that drawer guides 312N include a bracket 314N for engaging pins 24N. However, guides 312N can also be attached by separate rivets, bolts or fasteners (not shown) to dividers 22N.

Figure 39:
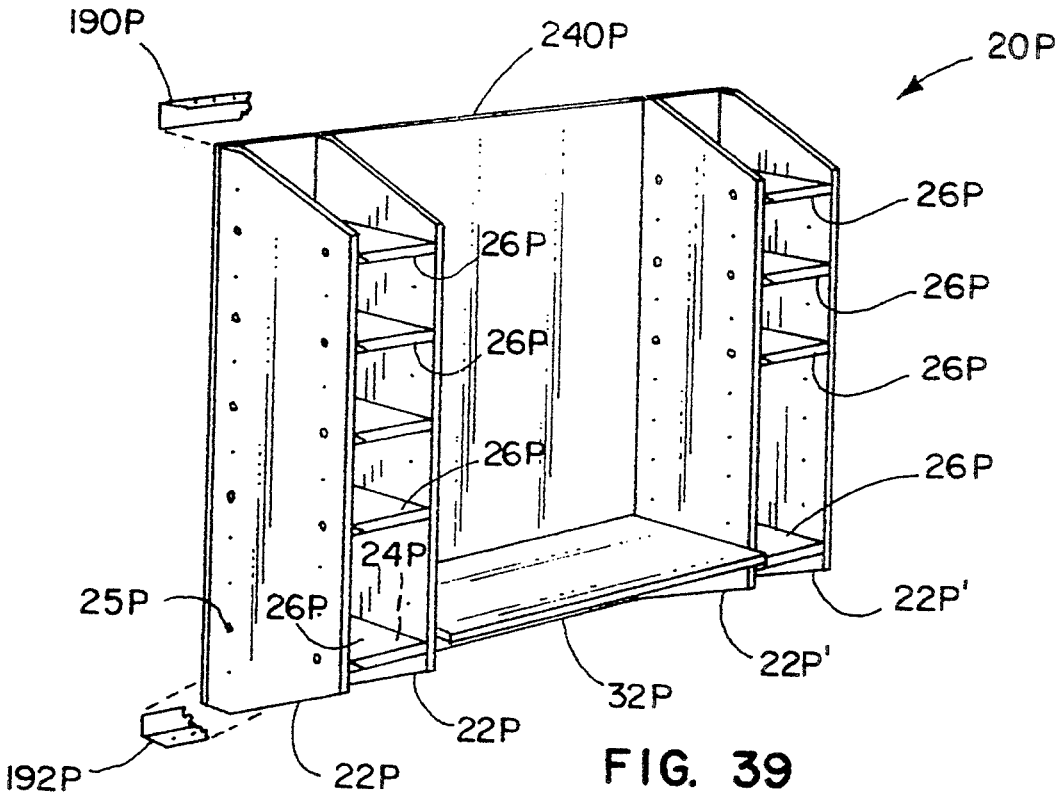
FIG. 39 is a perspective view of another system embodying the present invention, the system including a work surface and being wall hung.

In FIG. 39, a storage and work station system 20P is shown. System 20P includes four (or more) dividers 22P and 22P' supported on brackets 190P and 192P on a wall. (See FIG. 24.) A work surface 32P (FIG. 39) is supported between the inner two dividers 22P and 22P'. Shelves 26P are connected between the right pair of dividers 22P' and also between the left pair of dividers 22P'. This arrangement stabilizes the two dividers 22P and 22P' that support work surface 32P, tires providing a stable work surface to work on. Notably, worksurface 32P can include brackets (280P) where increased chip resistance is desired. Also, it is noted that storage and work station 20P could be constructed as a freestanding unit, or as a workstation on conventional gondola shelving.

Figure 40:
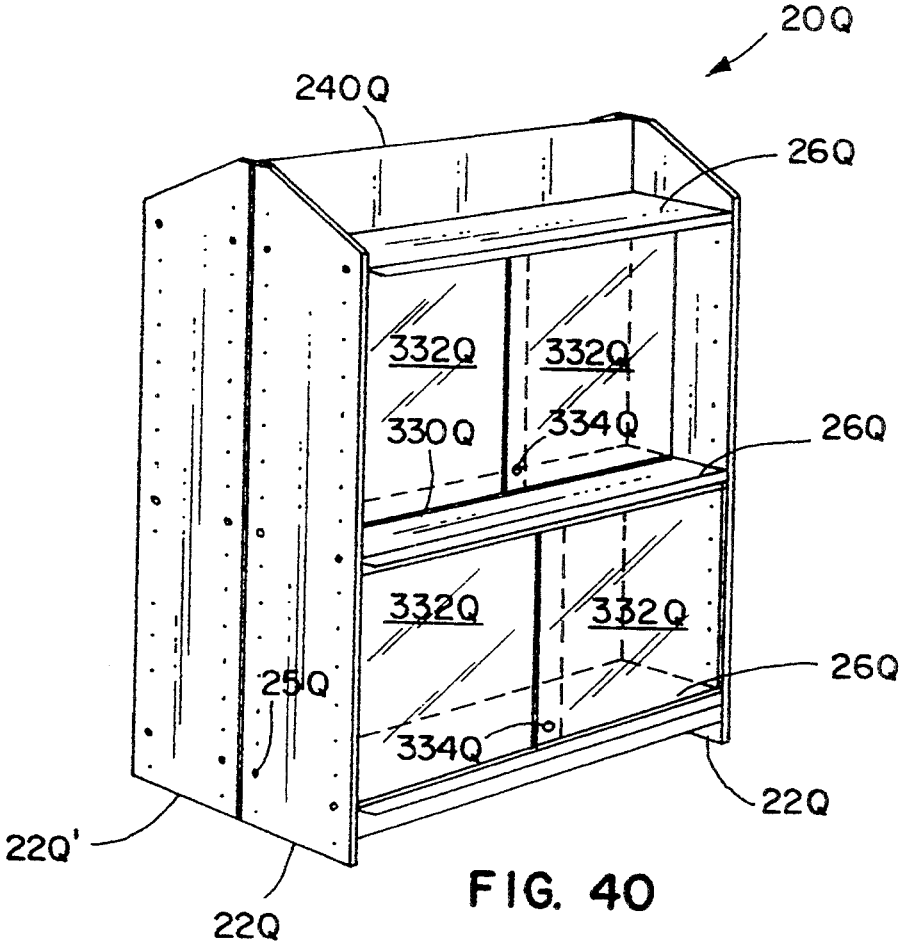
FIG. 40 is a perspective view of another display system embodying the present invention, the display system including sliding glass doors.

FIG. 40 illustrates a display system 20Q which includes a pair of dividers 22Q supporting top, intermediate and bottom shelves 26Q. Channels 330Q are attached to shelves 26Q, and a pair of glass doors 332Q are slideably mounted in channels 330Q between shelves 26Q for side-to-side movement. A lock 334Q in doors 332Q allows the doors to be locked in the closed position, as shown. The arrangement provides excellent visual access to goods displayed in the system 20Q, but prevents unauthorized access to the goods. More specifically, access to the goods is substantially prevented since top shelf 26Q is "too high" for easy lifting. Additionally, top shelf 26Q can be securely locked onto the pins 24Q that support the top shelf on dividers 22Q, such as by providing angled fingers (288Q) that lock onto pins 24Q and 25Q.

Figure 41:
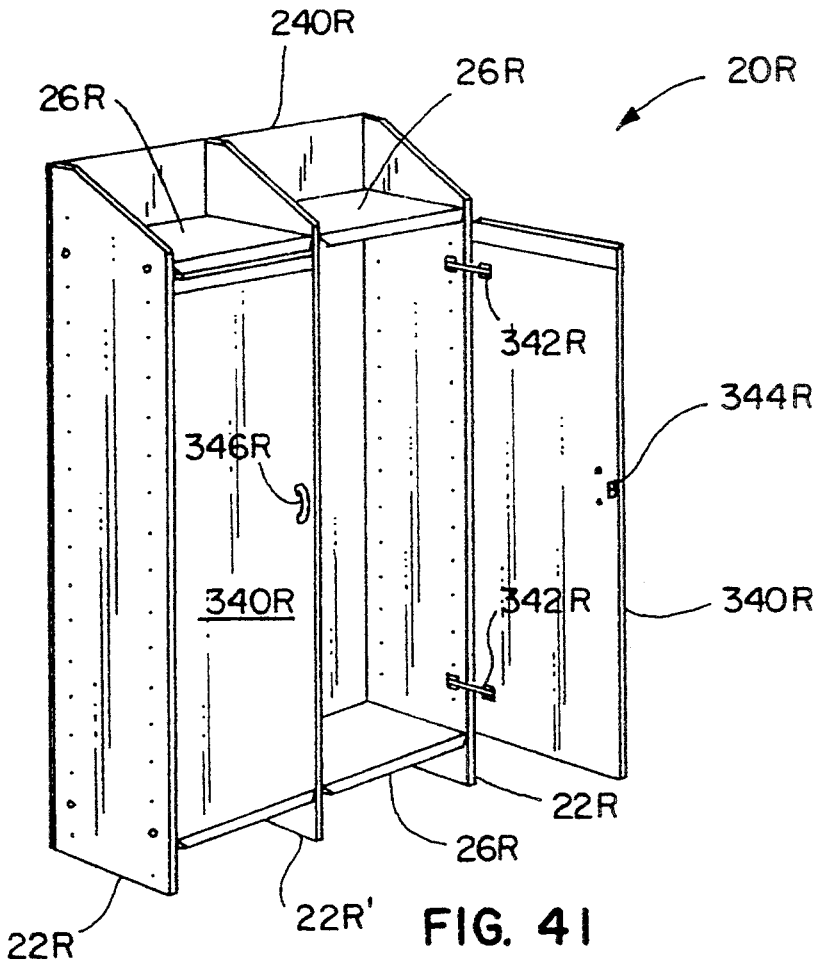
FIG. 41 is a perspective view of another system embodying the present invention, the system including hinged "closet" doors.

FIG. 41 illustrates that a locker system 20R can be made such as by providing a top and bottom shelf 26R and by attaching a closeable "closet type" door 340R to a divider 22R on hinges 342R between adjacent dividers 22R and 22R'. A releasable, lockable catch 344R for releasably engaging divider 22R' can be attached to door 340R along with a handle 346R to facilitate use of system 20R.

Figure 42:
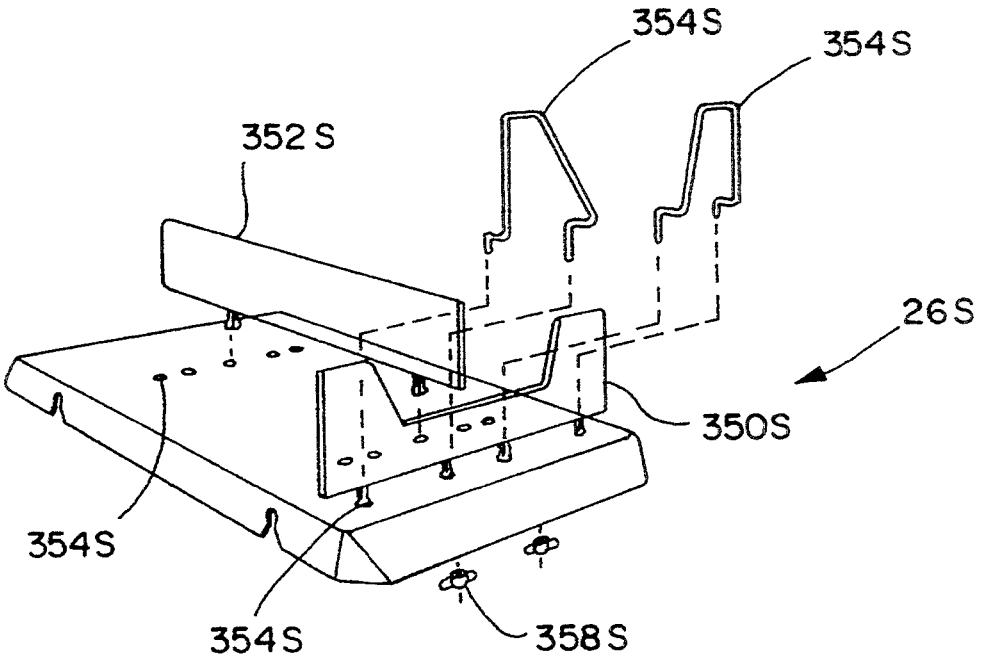
FIG. 42 is an exploded perspective view of a modified shelf for use with one or more of the above noted display and storage systems.

FIG. 42 illustrates a shelf 26S adapted with fences 350S, partition style dividers 352S and bent wire holders 354S. Fences 350S, partition style dividers 352S and holders 354S each include protrusions for selectively engaging holes 354S in shelf 26S to secure the respective components in desired positions on shelf 26S. Optionally, nuts 358S can be engaged with the protrusions to secure the shelf component in place.

Thus, the present invention provides display systems that include dividers interconnected by shelves and shelf supporting pins. In one aspect, a display system is provided that is readily installable on conventional gondola shelving by a top bracket and bottom locators. In another aspect, the display system can be attached to a support such as to 2×4 wooden studs of a building wall. In another aspect, a storage system and/or display system is free standing, and can be constructed with a variety of different shelving modules in custom arrangements. The display system can be readily assembled without use of skilled labor or special tools, and yet is adaptable to many different uses and arrangements.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A freestanding display system comprising;

a plurality of elongated upright dividers having a back edge and sides, said sides including first apertures and said back edge including second apertures;

a plurality of shelf supporting fasteners selectively located in said first apertures, each of said shelf supporting fasteners including at least one end protruding from one of said sides;

a plurality of shelves each including opposing sides having means for releasably frictionally engaging said protruding ends;

a back panel including third apertures alignable with said second apertures;

connectors extended through said third apertures into said second apertures;

retainers located in said second apertures for engaging said connectors and for securing said dividers to said back panel; whereby assembly of said plurality of shelves to said shelf supporting fasteners with said shelf supporting fasteners engaging said dividers and with said dividers located and secured by said retainers and said connectors to said back panel provides a rigid construction which can be assembled with unskilled labor in a variety of different arrangements.

2. A freestanding display system as defined in claim 1 wherein several of said dividers are located on opposing sides of said back panel.

3. A freestanding display system as defined in claim 1 wherein said connectors include a shaft and configured ends on said shaft, and said retainers include an inclined surface for engaging said configured ends and drawing said connectors and said upright dividers against said back panel.

4. A freestanding display system as defined in claim 1 wherein said back panel includes an upper section that extends above said upright dividers, said upper section including means for holding a graphic insert on said header.

5. A freestanding display system as defined in claim 1 including a header including opposing sides having means for releasably frictionally engaging said protruding ends of said fasteners, said header being engageable in an upright position and including means for securing a graphic insert to said header.

6. A freestanding display system as defined in claim 1 including a work surface including opposing edges having means for releasably frictionally engaging said protruding ends of said fasteners.

7. A freestanding display system as defined in claim 1 wherein several of said plurality of shelves are made from one of a wood material and a composite material, and including a plurality of reinforcement brackets attached to said several shelves, said reinforcement brackets being configured to engage said shelf supporting fasteners and thus distribute stress on said several shelves to promote a long service life of said several shelves.

8. A freestanding display system as defined in claim 7 wherein said several shelves are made from pressboard.

9. A freestanding display system comprising:

a plurality of dividers having sides and material forming a plurality of vertically spaced holes extending through the dividers between the sides;

a plurality of shelf supporting fasteners each having a shaft and ends, said fasteners being positioned in selected ones of the holes in said dividers with the fastener shaft being located in the selected holes and with the fastener ends protruding from the sides of each said divider, the ends of each said fastener being constructed so that the fastener ends are securely engageable;

a plurality of shelves each including a mid section and opposing sides, said opposing sides each including notches frictionally engageable with the fastener ends so that a particular shelf can be positioned between the sides of a pair of said dividers and press fittingly forced onto the fastener ends;

a back panel; and means for drawing said dividers against said back panel, whereby an arrangement of the shelves and the dividers can be made with the shelves and the back panel interconnecting the dividers to create a secure and stable system that can be assembled with unskilled labor in a variety of different configurations.

10. A freestanding display system as defined in claim 9 wherein said means for drawing includes at least one connector that extends through said back panel into one of said dividers, said one divider includes a retainer for engaging said connector.

11. A freestanding display system as defined in claim 10 wherein a selected pair of said dividers are positioned on opposing sides of said back panel, said at least one connector extends through said back panel into engagement with said selected pair of said dividers, said selected pair each including at least one of said retainers for engaging said at least one connector.

12. A storage and work station system for attachment to a wall, comprising;

an elongated top bracket and elongated bottom bracket adapted for attachment to the wall in a predetermined space or condition, said top bracket and said bottom bracket each extending the width of said system and including a plurality of longitudinally spaced anchor means along their length;

divider panels having a top and a bottom defining a height sufficient to engage said top bracket and said bottom bracket when the brackets are secured in the predetermined spaced apart condition to the wall, the top and the bottom of each divider having means for releasably engaging selected of said anchor means, said brackets being constructed to support the weight of said divider panels when said divider panels are engaged therewith;

a plurality of shelves adapted to be secured between said dividers to form said display system;

a plurality of shelf supporting fasteners extending through said divider panels, said shelf supporting fasteners including ends protruding from said divider panels, said shelves including first means for securely engaging selected of said fastener ends; and a work surface secured between a selected pair of said dividers, said work surface including second means for securely engaging selected of said fastener ends, whereby a storage and work station system can be readily constructed on the wall by unskilled labor.

13. A storage and work station system as defined in claim 11 wherein said selected pair of dividers each include a worksurface supporting side and an opposing side, and wherein several of said shelves are positioned on said opposing sides of said selected pair of dividers to engage and stabilize said selected pair of dividers and said work surface.

14. A storage and work station system as defined in claim 12 including a back panel positioned between said dividers and said wall.

15. A display system comprising:

a plurality of dividers having sides and multiple holes extending between the sides;

a plurality of fasteners including shafts and ends, said fasteners being selectively positioned in said holes with said shafts extending through said holes such that said ends protrude from said sides, said ends including a head and material defining a depression adjacent said head;

a plurality of shelves having sides including recesses for receiving said fastener ends; and a plurality of shelf reinforcement brackets attached to said shelves at least partially in said recesses, said body section including means for attaching to said shelves and further including material defining a notch shaped to frictionally receive and engage one of said fastener ends, whereby said plurality of shelves can be attached to said plurality of dividers and supported by said plurality of fasteners with the end of each said fastener end being closely engaged by one of said shelf reinforcement brackets to thus distribute stress and provide a long service life to said shelves.

16. A display system as defined in claim 15 wherein said shelves are made from one of wood and a composite material.

17. A display system as defined in claim 15 wherein said body section of each said reinforcement bracket includes a cylindrically-shaped wall configured to frictionally engage said shelf recesses, said cylindrically-shaped wall including said notch.

18. A modular display system comprising;

a plurality of dividers having sides and a plurality of holes extending through said dividers between said sides;

a plurality of fasteners adapted to be installed in said holes of said dividers, said fasteners including a shaft and at least one configured end, said shaft being positionable in selected of said holes with said at least one configured end protruding from said sides of said dividers;

a plurality of modular units each including opposing sides having front and rear recesses configured to interlockingly engage said configured ends of said fasteners, whereby selected of said modular units can be supported on said fasteners and in turn on said dividers with said dividers and said modular units being rigidly interlocked as a unit by said fasteners; and said modular units including a first type unit defining a planar shelf, a second type unit defining another shelf including a front edge configured to hold product information and pricing labels, a third type unit including a pair of shelves and a glass door slideably positioned between the pair of shelves; a fourth type unit including partitioned shelves having fences positioned thereon for dividing the partitioned shelf into product areas, a fifth type unit including a planar member with channels configured to receive and support a graphic insert, and a sixth type unit including a horizontally movable shelf with guides and a drawer member.

* * * * *

UNITED STATES PATENT AND TRADEMARK OFFICE

CERTIFICATE OF CORRECTION

PATENT NO. : 5,439,123

DATED : August 8, 1995

INVENTOR(S) : Thomas J. Nook

It is certified that error appears in the above-indentified patent and that said Letters Patent is hereby corrected as shown below:

Column 1, line 61:

"fleestanding" should be --freestanding--.

Column 2, line 32:

"Fig. 11" should be --Fig. 11A--.

Figure 21:
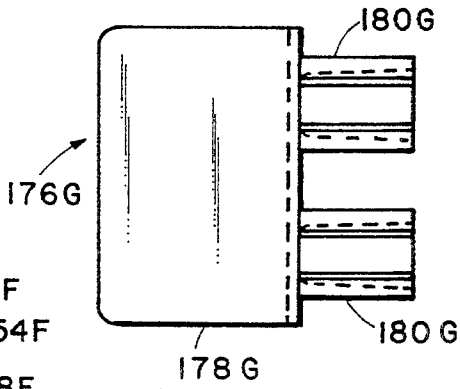
FIGS. 21–28 are orthogonal views of a modified locator bracket.
Figure 22:
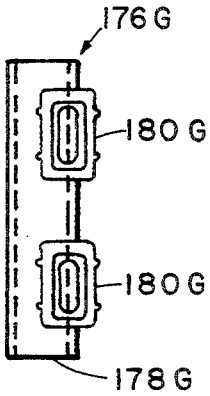
Figure 23:
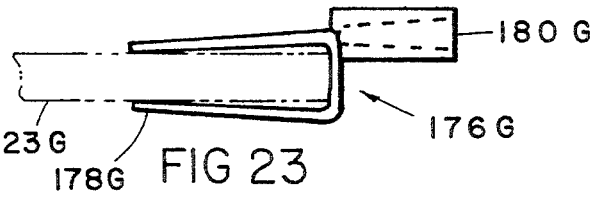

Column 2, line 49:

"Figs. 21-28" should be --Figs. 21-23--.

Column 2, lines 64 and 65:

"fleestanding" should be --freestanding--.

Column 3, line 32:

"Fig." should be --Figs.--.

Column 4, line 65:

"tipper" should be --upper--.

UNITED STATES PATENT AND TRADEMARK OFFICE

CERTIFICATE OF CORRECTION

PATENT NO. : 5,439,123
DATED : August 8, 1995
INVENTOR(S) : Thomas J. Nook

It is certified that error appears in the above-indentified patent and that said Letters Patent is hereby corrected as shown below:

Column 9, line 10:

"alighted" should be --aligned--.

Column 11, lines 24 and 25:

"rigidities" should be --rigidifies--.

Column 11, line 62:

"tires" should be --thus--.

Signed and Sealed this

Twenty-fifth Day of June, 1996

Bruce Lehman

*Attest:*

BRUCE LEHMAN

*Attesting Officer*

*Commissioner of Patents and Trademarks*